US010633149B2

(12) United States Patent
Fink et al.

(10) Patent No.: US 10,633,149 B2
(45) Date of Patent: Apr. 28, 2020

(54) MANIPULABLE CONTAINER HAVING REDUCED NECK HEIGHT FOR CLOSURE WITH A CLOSURE CAP, AND METHOD OF CLOSURE

(71) Applicant: Silgan Holdings, Inc., Stamford, CT (US)

(72) Inventors: Robert Fink, Hassloch (DE); Hans-Peter Hein, Suthfeld (DE); Helmut Klemm, Braunschweig (DE); Andreas Maniera, Neustadt (DE); Ludwig Kramer, Lathen (DE)

(73) Assignee: Silgan Holdings, Inc., Stamford, CT (US)

( * ) Notice: Subject to any disclaimer, the term of this patent is extended or adjusted under 35 U.S.C. 154(b) by 1039 days.

(21) Appl. No.: 14/902,470

(22) PCT Filed: Jul. 1, 2014

(86) PCT No.: PCT/IB2014/062759

§ 371 (c)(1),
(2) Date: Dec. 13, 2016

(87) PCT Pub. No.: WO2015/001479

PCT Pub. Date: Jan. 8, 2015

(65) Prior Publication Data

US 2017/0113847 A1 Apr. 27, 2017

(30) Foreign Application Priority Data

Jul. 2, 2013 (DE) ..... 10 2013 106 957
Nov. 21, 2013 (DE) ..... 10 2013 112 891
(Continued)

(51) Int. Cl.
*B65D 41/17* (2006.01)
*B65D 41/04* (2006.01)
(Continued)

(52) U.S. Cl.
CPC ..... *B65D 41/17* (2013.01); *B65B 7/285* (2013.01); *B65D 1/023* (2013.01); *B65D 1/0246* (2013.01); *B65D 41/0457* (2013.01)

(58) Field of Classification Search
CPC ..... B65D 41/17; B65D 1/023; B65D 1/0246; B65D 41/0457; B65D 21/0209; B65B 7/285
(Continued)

(56) References Cited

U.S. PATENT DOCUMENTS 1,842,429 A 1/1932 Scofield
3,374,601 A 3/1968 White
(Continued)

FOREIGN PATENT DOCUMENTS

CN 101980924 A 2/2011
DE 1607843 A1 3/1972
(Continued)

OTHER PUBLICATIONS

Office Action; Chinese Patent application No. 201480048466.7; dated Dec. 16, 2016; State Intellectual Property Office of PRC; Beijing, China.
(Continued)

*Primary Examiner* — Ernesto A Grano
(74) *Attorney, Agent, or Firm* — Stevens & Showalter LLP

(57) ABSTRACT

The invention relates to a container made of glass or hard plastic having a container neck (52) with a plurality of external thread elements (53, 54, 55, 56, 57, 58), which are offset circumferentially relative to one another, as thread segments. The container can be closed by means of the thread segments by a closure cap made of metal sheet, wherein the closure cap (1, 2) has a circumferential plastic layer (30;30*h*,30*v*) on the inside of the cap and on the rim of
(Continued)

the cap which has a sealing and retaining action. The closure cap can be pressed onto the container neck (52) and over the thread elements (53, 54, 55, . . . ) during closure and a vertical portion (30*v*) of the plastic layer can be opened with a rotary movement relative to the thread segments (53, 54, 55, . . . ). The container neck (52) has an upper horizontal end face (52*a*) as an annular surface which is adapted and suitable to be pressed into a horizontal portion (30 *h*) of the plastic layer (30;30*h*,30*v*) of the closure cap (1.2) under pressure and to produce a seal under pressure. An axial spacing (h54) is defined which extends between axially upper ends (53*a*, 54*a*, 55*a*, 56*a*, 57*a*) of the thread segments (53, 54, 55, 56, 57, 58) and a horizontal plane (E52*a*) through the horizontally oriented end face (52*a*) of the container neck (52) of the glass container (50). An annular width (b52) of the upper horizontal end face (52*a*) is defined as an annular surface. A ratio of the axial spacing (h54) to the annular width (b52) is less than 1.35.

5 Claims, 8 Drawing Sheets

(30) Foreign Application Priority Data

Feb. 21, 2014 (DE) ..... 10 2014 102 306
Mar. 27, 2014 (DE) ..... 10 2014 104 344

(51) Int. Cl.
*B65D 1/02* (2006.01)
*B65B 7/28* (2006.01)

(58) Field of Classification Search
USPC ..... 215/318
See application file for complete search history.

(56) References Cited

U.S. PATENT DOCUMENTS

| | | | | |
|---|---|---|---|---|
| 3,741,423 | A * | 6/1973 | Acton | B65D 41/0457 215/318 |
| 4,000,825 | A | 1/1977 | Westfall | |
| 4,552,279 | A | 11/1985 | Mueller et al. | |
| 4,603,786 | A | 8/1986 | Lecinski, Jr. et al. | |
| 4,709,825 | A | 12/1987 | Mumford | |
| 4,863,030 | A * | 9/1989 | Bayer | B65D 21/0209 206/427 |
| 4,989,740 | A * | 2/1991 | Vercillo | B65D 41/0457 215/252 |
| 5,740,914 | A | 4/1998 | Herzog | |
| 7,175,039 | B2 * | 2/2007 | German | B65D 41/3423 215/252 |
| 8,424,706 | B2 * | 4/2013 | Robertson | B65D 41/0442 215/317 |
| 2015/0225106 | A1 * | 8/2015 | Mayer | B65D 1/0223 215/44 |

FOREIGN PATENT DOCUMENTS

| | | | |
|---|---|---|---|
| EP | 0242419 | A1 | 10/1987 |
| WO | 02094670 | A1 | 11/2002 |
| WO | 2010136414 | A1 | 12/2010 |
| WO | 2012158937 | A1 | 11/2012 |

OTHER PUBLICATIONS

Office Action; Russian Patent application No. 2015154053; dated Apr. 19, 2018; ROSPATENT; Moscow, Russia.
Bridault, Alain; International Search Report and Written Opinion; International Patent Application No. PCT/IB2014/062759; dated Oct. 7, 2014; European Patent Office;Rijswijk, Netherlands.
Bridault, Alain; International Preliminary Report on Patentability; International Patent Application No. PCT/IB2014/062759; dated Oct. 15, 2015; European Patent Office; Rijswijk, Netherlands.

* cited by examiner 52a
51
7°
Detail
A
61
$h_{60}$
60
0.8
mm
$b_{52}$
55a
55
56

MANIPULABLE CONTAINER HAVING REDUCED NECK HEIGHT FOR CLOSURE WITH A CLOSURE CAP, AND METHOD OF CLOSURE

The invention relates to a manipulable container made of glass or hard plastic having a container neck with external thread elements, a closure cap being applied to the container neck (received on the container) by axial pressing-on and being released therefrom by a twisting operation. To be exact, the invention relates to a press-on/twist-off closure unit (press-on/twist-off as PT closure) in a special combination with a glass container or a glass vessel and a method of closing this container.

These closures allow containers to be sealed hermetically for packaging and preserving food, in particular baby food and sports foods. The food can be canned in a hot state and, after closure and cooling down, a vacuum will be created that may make the twist-off movement of the closure cap by the consumer much more difficult.

Closures of the "press-on twist-off" [PT] type have been known for a long time for use on glass or hard plastic containers. The preferred form of the closure lid comprises a metal shell with an upper face (panel) and a skirt section projecting axially (downwards) therefrom. The generally cylindrical upper portion of the skirt area is provided with a deformable plastic lining having thread turns formed therein, when the cap is vertically pressed onto a mouth provided with thread segments on the radially outer surface thereof. The consumer will be able to remove the closure cap by a normal twist-off movement later on, cf. U.S. Pat. No. 4,709,825 [Mumford], Abstract, WO-A 2002/094670 (Crown Cork & Seal), reference numerals 20 and 16 as well as the straight axial skirt 24 having a cylindrical shape and the external step provided in the glass according to FIG. 2 of this reference, slightly above the upper end of the thread segment 16. Also U.S. Pat. No. 4,552,279 (Mueller), cf. there the Abstract, and PT cap 10 for the thread segments 13 on the neck 12 of the container, shows such a closure.

According to well-tried prior art that has been in use for decades, the mouth of the container and the axially downwards projecting skirt section of the closure cap have comparatively long axial dimensions so as to accomplish hermetic sealing as a vacuum closure. The structural design of the plastic lining should, however, be configured such that it fulfills the sealing requirements for the vacuum closure on the one hand and can be opened by the consumer in a satisfactory manner on the other. At present, these two requirements can only be satisfied by axially long sections and, consequently, the use of a large amount of material.

It is the object of the present invention to reduce the amount of metal, glass and plastic required for creating the container, the closed closure unit (container and cap) or the closure unit to be closed, and the associated methods, without having any negative effects on quality, safety and user benefit.

Surprisingly enough, this object is achieved by a closure unit. It consists of a container (glass or hard plastic) having external, circumferentially offset and staggered (inclined) thread elements (also referred to as "thread turns" or "thread segments") on a container neck of the container. The container has associated therewith a closure cap made of sheet metal, the closure cap having on an inside of the cap a circumferential plastics layer arranged for sealing and retaining and producing a corresponding effect. The closure cap is (or: was) pressed onto the container neck and is openable by the thread segments and a vertical section of the plastics layer by a rotary movement. This describes its technical/structural design just like that of the container neck of the claimed container.

The claimed condition is, however, not only the closed condition, after the closure cap has been pressed onto the container neck, but also the two parts, which are intended for, but still separated from one another, are claimed. A product to be filled in the container is contained therein in the closed condition and sealed therein in a vacuum-tight manner by the metallic closure cap.

The closure cap is suitable for a plastic or glass container and is, to this end, also mechanically configured and adapted for use in the closure unit. The glass container has external, circumferentially offset thread elements, which replace a continuous thread, but may be arranged in staggered mode on the circumference. These thread segments are arranged on a container neck of the container body that is intended to have the closure cap (also "metallic" closure cap) associated therewith. This association takes place within the framework of the PT concept, where the cap is first pressed on axially and removed by the user, as customer (or consumer), by a rotary movement.

The closing takes place at the filler's, where the sealing effect between end face and plastics layer is accomplished by pressing-on after the filling process. During pressing-on, the end face is pressed to a substantial extent into the horizontal section of the plastics layer.

The short mouth (a shortened neck) of the container for the closure cap is particularly important for the solution. The above-mentioned object is also achieved by a method of closing. The shortened container mouth particularly contributes to the saving of material and accomplishes nevertheless the demanded vacuum-sealing reliability in combination with the satisfying way of opening the closure cap.

Possible fields of use are the following ones:

- a hermetic sealing of containers for packaging and preserving food (aliments), especially baby food and sports foods.

The food can be canned in a hot state and, after closure and cooling down, a vacuum will be created that may make the twist-off movement of the closure cap by the consumer much more difficult.

The materials adapted for use as the claimed plastics layer are elastic elastomers with or without PVC or TPE (thermoplastic elastomers), e.g. a thermopolyethylene, or similar plastic material. They are adapted for cold filling at a few degrees centigrade above zero (less than 10° C.), filling at room or normal temperature (about 20° C. to 25° C.), filling with subsequent pasteurization (up to approx. 110° C. at the most) or filling with subsequent sterilization (up to 125° C.) of the filled-in product. Some modern compounds used as a plastics layer are able to cover all the temperature ranges referred to, i.e. they are suitable for use for all variants of thermal filling or thermal treatment. It is, however, still possible to favor specific compounds for specific temperature ranges and use, in so doing, the various variants mentioned at the beginning of this paragraph.

Within the framework of the above outlined thermal filling or thermal treatment, there are a large number of "customer conditions", i.e. filling variants used at the filler's. The claimed closure unit consisting of the container and the metallic closure cap or the container itself (made of glass or hard plastic) are filled at the customer's and then closed. Likewise, also the containers are fillable at the customer's in this way and closable according to a method. The closed condition is described with respect to the (still open) condition of the closure unit. The customer will here adjust his filling conditions such that they are suitable for the product to be filled in and will impart thereto the necessary properties for the transport path as well as for the period of time which this container with its filled-in content will have to wait on the shelf for the customer.

The different filling conditions or variants (also referred to as "conditions") lead to different results of product performance. For example, during sterilization with compensation pressure, much stronger forces act on the compound (the plastics layer), a circumstance that may result in severing and, consequently, vacuum losses and therefore the future decay of the product filled in. In addition, the different conditions also lead to deviations in the behavior of the opening force, which will be perceived by the user directly when he unscrews the PT closure cap from the closed container.

During the filling process, the temperature of the filled-in product and the temperature of the treatment process, to which the filled-in product in the container is exposed, will have to be differentiated. Rough limits can be defined in this respect.

A process is referred to as "cold filling" (coldfill) when the temperature of the filled-in product is lower than 70° C. (from a few degrees centigrade above zero up to substantially 70° C.). Above this value of substantially 70° C., the person skilled in the art speaks of "hot filling" (hotfill).

The thermal aftertreatment may take place in the form of pasteurization or sterilization, the sterilization acting on the filled-in product with a temperature of more than 110° C., up to a maximum of 125° C. at present. Below 110° C. down to approx. 98° C. of the temperature of the aftertreatment, the person skilled in the art speaks of pasteurization.

Pasteurization ("past") and sterilization ("ster") can be carried out with or without counterpressure. Naturally, the counterpressure during pasteurization is slightly lower, e.g. less than 0.15 MPa, whereas in the case of sterilization it is significantly higher and amounts up to 0.25 MPa. The period for which the temperature is applied during the aftertreatment is between 15 min and 60 min. During sterilization, the filled-in product is exposed to the higher temperature and the pressure for a longer period. Of course, this also stresses the closure unit, primarily the compound (the plastics layer), which is exposed to high thermal loads and has also pressure applied thereto during pasteurization or sterilization due to the internal pressure building up in the closed container (with outwardly directed pressure that can be counteracted by a counterpressure and/or by the thread segments having a "shearing strain" applied thereto by the compound in the closure cap acted upon by a lift-off force). Vice versa, a vacuum builds up during the cool-down phase, which applies to the closure and in particular to the compound a pressure acting in a direction opposite to the pressure applied during the thermal treatment. The closure cap and primarily the plastics layer must be able to take up the developing excess pressure as well as the negative pressure existing after cooling and to sealingly close nevertheless as well as to remain permanently tight.

It should be mentioned that the filled-in product is filled with an initial temperature lying below the temperature at which the thermal aftertreatment takes place or corresponding, at most, to the magnitude of this temperature. During an "aftertreatment" without pasteurization or sterilization, there is no temperature influence causing a heating effect. The warm to hot (preheated) filled-in product having a coldfill temperature of up to 70° C. and a hotfill temperature of up to 98° C. is cooled down only passively, in the sense of "is allowed to cool down", after having been filled in. The higher the filling temperature of the filled-in product was, the longer the cooling period will be.

Analogously to the above, the thermal aspect of aftertreatment can be subdivided into four categories, viz. no such aftertreatment, the aftertreatment only consists of the (passive) cooling down of the filled-in product, the aftertreatment consists of pasteurization or the after treatment consists of sterilization (followed by a technically controlled cooling down in the case of the last two categories).

When higher temperatures are employed during pasteurization or sterilization, controlled cooling down will take place after the influence of the higher processing temperature so as to cool the closed containers to a transport temperature and obtain the desired differential pressure on the PT closure cap in the cool-down phase. The final temperature often corresponds to room temperature. The filled-in products, which are filled in the cold condition or at room temperature, need not be cooled down.

From the above described cases of use it can be seen that there is a large number of combination possibilities, which are to be considered as being additionally disclosed, analogously, to those skilled in the art in the above description passages, e.g. a combination possibility where sterilization takes place at 125° C. for a period of approx. 60 min, without any counterpressure being used. Subsequently, control cooling down takes place.

A saving of feedstock (glass or hard plastic) is favored by the axially comparatively short skirt of the closure cap. A saving of sheet-metal feedstock is accomplished by the axially shortened skirt lying in the range of the largest radial dimension and manifesting itself therefore in the saving of surface area by the square of the radius.

The saving of the feedstock plastic (compound or sealing means) follows the axially shorter skirt that has to be coated over a shorter length on the inside thereof.

The closure cap has to be axially pressed onto the container neck and over the thread elements. It is adapted and configured accordingly, the closure cap having a plastics layer abutting, on an inside of the cap, on a circumferential transition zone and on the skirt section in permanently adhering contact therewith. This plastics layer has axial dimensions and radial dimensions.

The above-mentioned transition zone is circumferentially oriented, it connects the central area of the closure cap (normally referred to as "panel") with the skirt section projecting axially downwards. The latter merges with a rolled-in area that may comprise an inward curl or an outward curl.

The closure cap can be released from the container neck and the thread elements by a screwing operation carried out by the consumer. This release movement must be effortless, i.e. also elderly people and children must be able to carry it out, and this is opposed to the wish of having adequate tightness and a long storage life in the closed condition. All the functions are part of a difficult matching process, which has to take place between adequate sealing—pressing the closure far down in the axial direction and, consequently, long axial sections on the neck (the mouth) and on the closure cap—and effortless rotating for overcoming (breaking) the vacuum building up in the closed container after cooling down.

This axial force transmitted by the thread elements to the compound is adapted very precisely and must be matched; if this force is too small, the cap will remain down and cannot be unscrewed (by the rotating movement) in the axial direction. If the force with which the compound adheres to the thread elements is not strong enough, the retention will not suffice for sealing during transport, during stock keeping and during the period of offer for sale on the shelf and also in the case of temperature fluctuations. If the force is too strong, it will be difficult to open the closure. The vacuum in the container is another factor to be taken into account and influences the forces referred to.

The container neck has a horizontally oriented "surface" (the upwardly directed end face), whereon a horizontal section of the plastics layer on the closure cap is able to sealingly rest and presses thereinto in the closed condition to such an extent that sealing is effected by pressure and pressing in.

The closure cap has a central area with an adjoining circumferentially oriented transition zone and a skirt section projecting axially downwards and merging with a rolled-in area. The plastics layer is adheringly provided on the inside of the cap at the transition zone and the skirt section.

Being a component part of the closure unit, the closure cap succeeds in fulfilling this combined task by realizing a ratio of two functional elements, which is defined as follows:

An axial extension of the skirt section and a radial extensions of the transition zone define a first ratio, referred to as ratio $v_1$, that is smaller than 3.00. It is much smaller than the ratio defined in the prior art. This leads to the surprising effect that, in spite of a shortened skirt section, a (still) sufficiently large circumferential area is available for permanently sealing the closed combination of closure cap and hard-plastic or glass container. Additionally, a sufficient lifting force can develop during rotation, which is generated as an axially directed removing force in response to the rotation, and the force required for rotating, i.e. first the breaking torque, is not excessively high and can also be accomplished or applied by elderly people.

To the person skilled in the art it seems as if, due to the reduced length of the skirt section, the force created will be too weak and the sealing zone in the axial direction will be too short, but this was, surprisingly enough, not confirmed by tests. In fact, these tests showed, very surprisingly, that a sufficient sealing effect and a sufficient strong axially directed removal force is accomplished nevertheless. This deviates from many years of prior art and also from many years of experience. Also axially short dimensions of the skirt section, which may also become smaller than the radial extension of the transition zone, where the radially directed section of the plastics layer (normally referred to as "compound") is located, are capable of satisfying the functional requirements. Here, a second ratio, referred to as $v_2$, participates. It is defined by the axial extension (illustrated as: $h_0$) of the skirt section of the closure cap and a radial extension (illustrated as: dr) of the transition zone as being smaller than one (read as 1.00).

This results in a saving of compound and sheet metal due to the comparatively short axial skirt, and feedstock is saved with respect to the correspondingly shorter configured mouth section of the plastic or glass containers, which also are or may be reduced in length in the axial direction in comparison with the prior art.

The upper end face of the mouth area of the container presses functionally precisely and reliably into the radially oriented section of the plastics layer. When the closure cap has been pressed on, this mouth area or the upper end face, respectively, even presses into the plastics layer to a certain extent, where it forms a sufficiently large, three-dimensional sealing area (as an annular surface), so that not only a mere contact but sealing that is effective down to a considerable depth under pressure is given with respect to the horizontal section of the plastics layer of the closure cap.

The container neck has the upper horizontal end face that is configured as an annular surface with an annular width. It is adapted and suitable for pressing-into a horizontal section of the plastics layer of the closure cap under pressure and for producing a seal under pressure.

According to a first solution, a (third) ratio is defined for the container (made of glass or hard plastic). This ratio of the axial spacing to the annular width is smaller than 1.35 according to this solution. The axial spacing (illustrated as: $h_{54}$) is defined as follows: it extends between the axially upper ends of the circumferentially offset thread elements and a horizontal plane through the horizontally oriented end face of the container neck of the container. The annular width is defined by the upper horizontal end face as an annular surface. It is a component part of the three-dimensionally effective sealing area.

This sealing area on the container neck extends, according to another solution, at the outside up to an outwardly directed (=external) step positioned axially above the upper ends of the circumferentially offset thread elements and below the horizontal end face. During closing, the container neck presses into the horizontal section of the plastics layer up to this step for producing a seal under pressure. It is thus described that the step is positioned on a very high level, i.e. close to the sealing area on the container.

For the container (made of glass or hard plastic) a spacing dimension of its structural design is specified in another solution. The container neck has the external step provided thereon. The external step is positioned axially above upper ends of the thread segments and below the horizontal end face such that the axial spacing between the step and the upper horizontal end face does not exceed 1 mm. The step has thus imparted thereto the aptitude and the characteristic of pressing into the horizontal section of the plastics layer (on the cap) for producing a seal under pressure.

According to still another solution, a (fourth) structural ratio is defined for the container (made of glass or hard plastic). The container neck has here provided thereon the external step that is positioned axially above upper ends of the thread segments and below the horizontal end face. As regards the container and its structural design, the fourth ratio holds true. It is defined from an axial spacing (illustrated as: $h_{60}$) between the external step and the upper horizontal end face and from a radial width (illustrated as: $b_{52}$) of the upper horizontal end face (52*a*) as an annular surface, and this ratio ($h_{60}/b_{52}$) is smaller than 0.7, and preferably even smaller than that.

Additional savings result from preferred, even more significant reductions of length, expressed either by a glass-container internal ratio or by height dimensions at the mouth of the glass.

The aim achieved by this reduction of length of the neck or the purpose assigned thereto is to be seen in a double reduction of the amount of material required. While maintaining the same sealing effect, it can be achieved that the thread segments approach the sealing profile more closely, so that glass will be saved; if hard plastic is used instead of glass, the material saved will be hard plastic. Parallel or simultaneously, material is also saved on the cap side. The skirt of the cap can be reduced in length, since it need not extend axially downwards on the mouth of the container as far as before for arriving at the thread segments and covering the same.

The fact that there is no change in the sealing area contributes to making it unnecessary that material components, which are omitted in the axial direction, have to be added in the radial direction, so as to accomplish there a supplementary sealing effect for the omitted axial sealing effect. Instead, the radial dimension of the sealing area should not change in comparison with that known from the prior art. The container around this sealing area, however, will be organized differently, as regards a saving of sheet metal for the cap and other savings at or in the mouth area of the container.

If the person skilled in the art transferred the sealing area from an axial zone into an enlarged radial zone, a larger amount of material would again be necessary, viz. glass (or hard plastic) and also material for the cap (metallic surface or disk diameter). The cap would extend more significantly or further outwards in the radial direction for shifting the cylindrical skirt further outwards in the radial direction, so as to allow the latter to adequately grip over the thread profile that is hypothetically assumed to be positioned further outwards.

The above applies analogously to the compound or sealing material in the cap, also in this case more material would be required, if the sealing area were transferred from an axial zone to a radial zone. According to the present invention, the amount of material required can be reduced for all the kinds of materials used.

The proportions and dimensional data described characterize a short container neck (vessel neck) in the mouth area, and while maintaining an equally effective sealing area with respect to the horizontal section of the plastics layer (of the compound or sealing material arranged in the cap), these short dimensions are accomplished by shifting the thread segments closer to this three-dimensional sealing area. In so doing, material above the thread segments and at the lower end section of the sealing profile was removed, saved, and the short dimensions of the neck were achieved in this way.

Tests have shown that precisely this zone directly above the step provided on the container neck and above the axially upper ends of the thread segments in the case of some embodiments does not produce an essential sealing effect, but that the sealing effect is primarily produced in the horizontal section of the plastics layer and that the vertical section contributes to the sealing effect of the three-dimensional sealing area only to a minor extent or not at all. An axial piece of an allegedly necessary sealing area directly above the circumferential step is omitted. This affects a portion of the container neck which has hitherto been considered as contributing to the a sealing effect and a necessary retention of the sheet metal cap after pressing-on. According to the more far-reaching findings of the present invention, neither is the case. Shortening to a certain extent is here possible, whereby, surprisingly enough, not only glass material can be saved, but in particular also the sheet metal material for the associated cap. Auxiliary measures or compensation measures for adding at some other point the materials saved are not necessary, but the saving is absolute and without any negative influence on the effects to be produced by the two components, cap and container neck, at the container, viz. the sealing effect and the retaining effect.

The above is advantageously supplemented by a third effect occurring as a surprise. It is the reduced opening force or break-open moment, which a user has to apply at the beginning for initially rotating the closure cap on the thread segments (causing it to execute a rotary movement), overcoming, in so doing, a possible vacuum and opening the closed container by continuing to rotate the closure cap.

The force required to this end should be as small as possible and, in the case of the claimed container having the shorter neck section, it becomes even smaller, since the removed axial zone lies in the end region of the three dimensional sealing area. This section positioned above the axial upper ends of the thread segments contributed to friction, and this is no longer the case according to the present invention. If a circumferential step is provided, the omitted axial zone is located directly above this step.

In spite of the advantageous omission of this friction component, the sealing effect and the retaining effect on the thread segments are comparable to those accomplished in the prior art, but this effect is achieved by the use of a smaller amount of material.

Reference should be made to the fact that the reduction of length of the neck and the above-described resultant effects is not a proportional reduction, which might perhaps be considered obvious. This reduction of length consists of the removal of a substantial piece of an axial length at a position, which the person skilled in the art previously considered to be relevant for retention or for a sealing effect. That this portion may have been optional or dispensable was unknown.

A method of closing a closure unit consisting of a container having external, circumferentially offset thread elements on a container neck of the container that is preferably made of glass, and a closure cap made of sheet metal, comprises at least the following steps:

a. providing the container having an end section with many thread elements (also referred to as "thread turns") extending thereon in a circumferentially offset and inclined mode. These are thread segments defining in common the thread profile.
b. Providing the closure cap made of sheet metal, a plastics layer being, on an inside of the cap, in adherent contact with a transition zone and a skirt section dimensioned according to the order of magnitude of the radial extension of the transition zone;
c. filling the glass container (with a victual from the food sphere). This can be done in a hot or in a cold condition and may be followed by a thermal treatment for pasteurization or sterilization.
d. pressing the closure cap onto the end section of the container with a three-dimensional sealing area as a sealing profile, with an upper horizontal end face as a component part of the three-dimensional sealing area, so that a horizontal section of the plastics layer defines a sealing and the thread profile thus approaches the sealing area to an extent corresponding to the width of the upper horizontal end face.

The closeness can be specified in more detail. The linear dimension of the closeness is specified by the radial width of the horizontal end face, so that no relative terms remain. This is a container-internal comparison that can easily be remeasured on any container. Since the horizontal end face is as narrow as possible (for providing a sufficient sealing effect), also the new neck geometry is as short as possible.

A quotient defines the ratio. This ratio expresses that the axial skirt section is short or reduced in length. The skirt section is related to the radial extension of the transition zone of the cap, in which zone the horizontal section of the sealing means is positioned. The examples disclose for various cap diameters between 4 cm and 7 cm ratios lying in the range between 1.1 and 0.8.

An axial spacing and the annular width of the horizontal end face of the neck may define a further characterizing ratio. The annular width is responsible for sealing, the axial length of the distance between this horizontal end face and the axially upper ends of the thread segments defines the short dimensions of the neck, so that these two dimensions and their ratio define a characteristic for a neck geometry of reduced length providing still sufficient tightness.

If the step, which is positioned at the outside, is additionally provided, it can be said that the container neck is capable of pressing into the horizontal section of the sealing plastics layer preferably up to this step. When such external steps have hitherto been used in the prior art, their axial spacing from the three-dimensional sealing area was so large that they were unable to engage with the horizontal section of the plastics layer in the closure cap. This refers to the group of et seq., which, according to its fundamental concept, does not yet assume that a (circumferential) step must inevitably be provided on the container neck, but adds this possibility only as an option, and specifies then, however, up to which extent or, expressed from an axial point of view, up to which depth this step is capable of engaging the compound of the transition zone of the closure cap.

The closeness of the thread segments and of their upper ends, respectively, and their closeness to the horizontal end face represent a further means of characterizing the short dimensions of the neck, describing it or expressing it by technically understandable values that are more accurate and more precisely defined than the indication "short closure neck". To this end, a horizontal dimension is related to a vertical dimension on the vessel (on the container made of glass or hard plastic, but definitely not of a flexible or resilient plastic), or the vertical dimension, which is "short", is compared with the horizontal dimension. The resultant axial spacing between the axially upper ends of the thread segments and the horizontal end face of the three-dimensional sealing area does not exceed 1.5 mm. This dimension is provided with an uncertainty range (also referred to as: tolerance range) comprising ±10%. These data specify a container neck having a structural design that is short, reduced in length and compact. The same results from the description that a maximum dimension of the spacing is predetermined. Hence, the distance may be smaller, this being still understood as closeness, and must not assume a value that exceeds the upper limit of the distance (the "maximum dimension").

It is understandable that the transition zone, whose name originates from the transition between the panel (cap face) and the axial skirt (skirt section), also comprises arcuate elements. A radial outer end section of the transition region is therefore a 90° curved arc for merging the cap face with the continuously straight skirt section.

When an inward curl is arranged at the lower end of the skirt section extending in a continuous, straight shape and having no mechanical beads or thread elements provided thereon, a transition area is formed between this inwardly extending rolled-in area (directed radially inwards) and the lower end of the straight skirt section. This transition area causes an expansion in the radial direction, so that there will be sufficient space, defined by the spacing, outside the container wall (the lower end of the mouth area) for the inwardly directed curl adjoining this expansion.

According to a preferred embodiment, the rolled-in area (outward curl or inward curl) comprises a complete turn. In the outer curvature area of the transition zone of the closure cap, an arc is preferably provided, so that the preferably straight, axially downwardly projecting skirt section extends between said arc and the curl.

Reference should be made to the fact that the term "rolled-in portion" or in short "curl" does not only comprise an inwardly directed rolled-in portion, but, making use of this term, also an outwardly directed rolled-in portion is claimed.

According to a preferred embodiment, the specified (second) ratio of the axial extension of the skirt section and of the radial extension of the transition zone is larger than 0.85 and also smaller than 1.0. For additional preferred embodiments of the specified second ratio, the outward curl and the inward curl "play a role". This relates to specially preferred ranges of the second ratio. Preferably for the inward curl, the ratio lies at 0.9 with a range off ±5% deviation, in particular at 0.89 with a deviation range or a tolerance band off ±1%. These more precise tolerance bands or ranges are intended to replace and illustrate the term "substantially" that is not easily grantable at present.

Preferably in the case of the outward curl, the (second) ratio is in the range of 0.98 having a tolerance range or protective range off ±2%, so that, mutatis mutandis, the second ratio can also here be considered to lie substantially at 0.98. This applies preferably to the outward curl having no bell-shaped expansion after the axially extending skirt section, as is the case with the inward curl.

The closeness of all axial upper ends of the thread segments (the circumferentially offset thread elements occupying each only a part of the circumferential length and being oriented at an oblique angle and circumferentially staggered) is a dimension that can define a plane having an axial height and an axial spacing (illustrated as: $h_{54}$). This axial spacing is short, and definitely much shorter than that according to the prior art. The axially upper ends are displaced upwards very far towards the three-dimensional sealing area, or, in other words, the horizontal section of the sealing area is shifted or displaced downwards very close to the axially upper ends. This spacing is preferably less than 2.0 mm. Preferably, it may become even shorter (claim 11), the spacing being then less than 1.6 mm. The container neck will be reduced in length even further, when the spacing is smaller than or equal to 1.3 mm.

Belonging to the press-on/twist-off closure, a container is provided, which has an end section having provided thereon at least two, but preferably many thread segments extending thereon circumferentially (and at an oblique angle). Due to their large number, these inclined thread segments are interleaved or staggered relative to one another and outwardly directed on the circumference of the container mouth.

The closure cap is pressed on axially, i.e. it is pressed across the thread segments in an axial direction by a pressing force, and this has the effect that, due to their stiffness, the thread segments will press into the elastic plastics layer. This guarantees that, during subsequent twisting off and further rotation of the cap, the inclined segments in the pressed-in paths on the cap will axially lift the closure cap upwards. As long as there is no such turning moment, the pressed-on closure cap will remain positioned on the end section of the container (the mouth area) such that the plastics layer arranged, on the cap side, at the transition zone and the skirt section enters into axially locking contact with the thread segments of the container along the axial section thereof.

According to a method for releasing the sheet metal cap from the container arrangement, the thread segments are circumferentially guided so as to axially lift the sheet metal cap and release it from the thread segments, whereby the combination of closure cap and container will be opened.

The axial skirt section of the closure cap and the axial height of the container mouth (with the thread segments) is much longer or larger in the prior art than the dimensions suggested by the solutions according to the present invention.

A comparison with a closure cap commonly used in the prior art will show this. There, the axial length of the skirt section lies at approx. 6.5 mm and the radially directed transition zone lies at approx. 4.6 mm, so that a ratio of approx. 1.4 is obtained. The ratio claimed is, however, a ratio of not more than 1.0 for the much shorter axially directed skirt section.

As regards the mouth of the glass, an axial length of approx. 2.8 mm above the thread segments is nowadays commonly used in the prior art. This value can be reduced to values below 2.0 mm (i.e. by more than 25%) according to the present invention, without any change in functionality.

The ratio of the axial extension of the skirt section with respect to a radial dimension of the horizontally directed end face provides a very compact closure area of the closure unit. A dimension of the metallic closure cap is here related to an end-face-side dimension of the glass container (or vice versa). One of them is directed axially, the other one radially. For defining the horizontal end face, an imaginary plane can additionally be taken into account, which also allows a dimensioning of the axially upper ends of the thread elements. The thus definable axial spacing has a dimension that is smaller than 2.0 mm. This stands for an axial section of the container neck that has been substantially reduced in length in comparison with the prior art, this section having no thread elements provided thereon. The thread elements are arranged on a section located axially further down, so that they are not omitted. This is described by a horizontal plane extending through the horizontally oriented end face of the container neck. The distance between this plane and the upper ends of the plurality of circumferentially offset thread elements is only "a short distance", definitely less than 2.0 mm, preferably less than or equal to 1.6 mm (claim 11) and particularly preferred less than or equal to 1.3 mm.

It can be seen that an axial section, which is presumably used for sealing purposes in the prior art, can be omitted, without the sealing effect being impaired. The amount of material required is reduced as regards glass, compound and sheet metal.

As regards the short skirt definition used for the closure cap, the definition (ratio $v_1$) can have added thereto the definition according to (ratio $v_2$). A multiple determination of the "reduced length" is then given, the axial extension of the skirt section being then a constituent part of both ratios, viz. the first and the second ratio.

The radially outer end section of the transition area may have a 90° curved arc. It merges directly with the straight skirt section. In order to illustrate the terms horizontal extension as well as vertical extension and axial extension, respectively, the axially straight skirt section is perpendicular to the plane in which the central area of the closure cap lies.

As regards the rolled-in portion at the lower edge of the skirt section, there are two variants, viz. the outward curl and the inward curl. The term curl stands for a substantially circular formation. If this circular formation is an outward curl, it adjoins the straight skirt section directly.

If the rolled-in portion is an inward curl, a transition area creating an expansion of the radial dimension of the skirt is provided between the straight skirt section and the inward curl.

In the case of this inward curl, the first ratio is preferably of such a nature that it is less than 2.70.

Embodiments illustrate and supplement the claimed invention.

FIG. 1 illustrates a mouth area of a glass vessel 50 having a closure cap 2 attached thereto, in an axial sectional view and as an enlarged detail representation. The closure cap 2 is a PT closure cap.

FIG. 6*a* shows an upper end of a thread element 55 in an enlarged representation.

Figure 6:
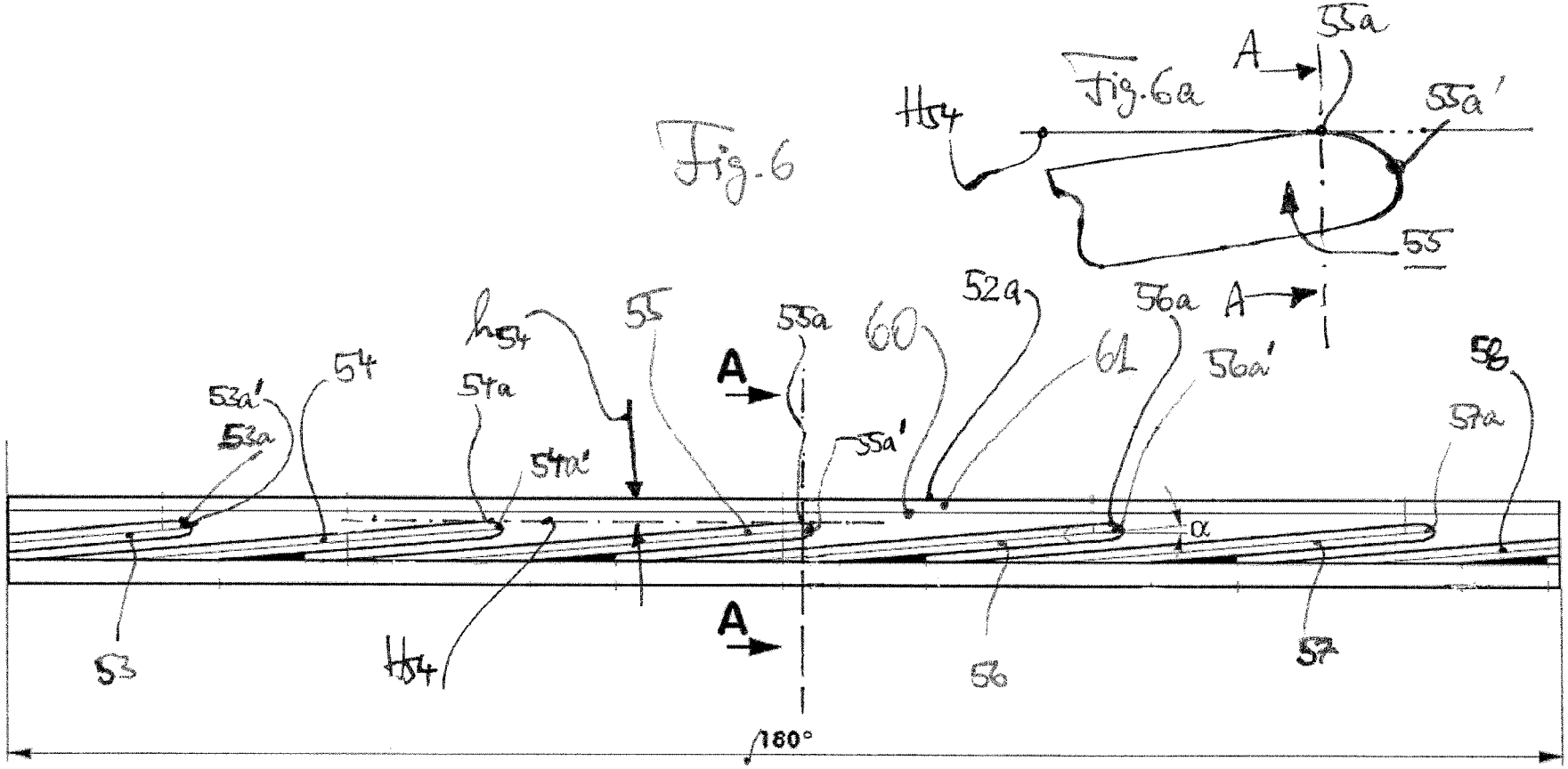
FIG. 6 shows, from radially outside, a view unrolled into a plane for making the inclined, staggered thread elements (as thread segments) 53 to 58 visible on the mouth area 52. 180° of 360° are shown.
Figures 7, 8:
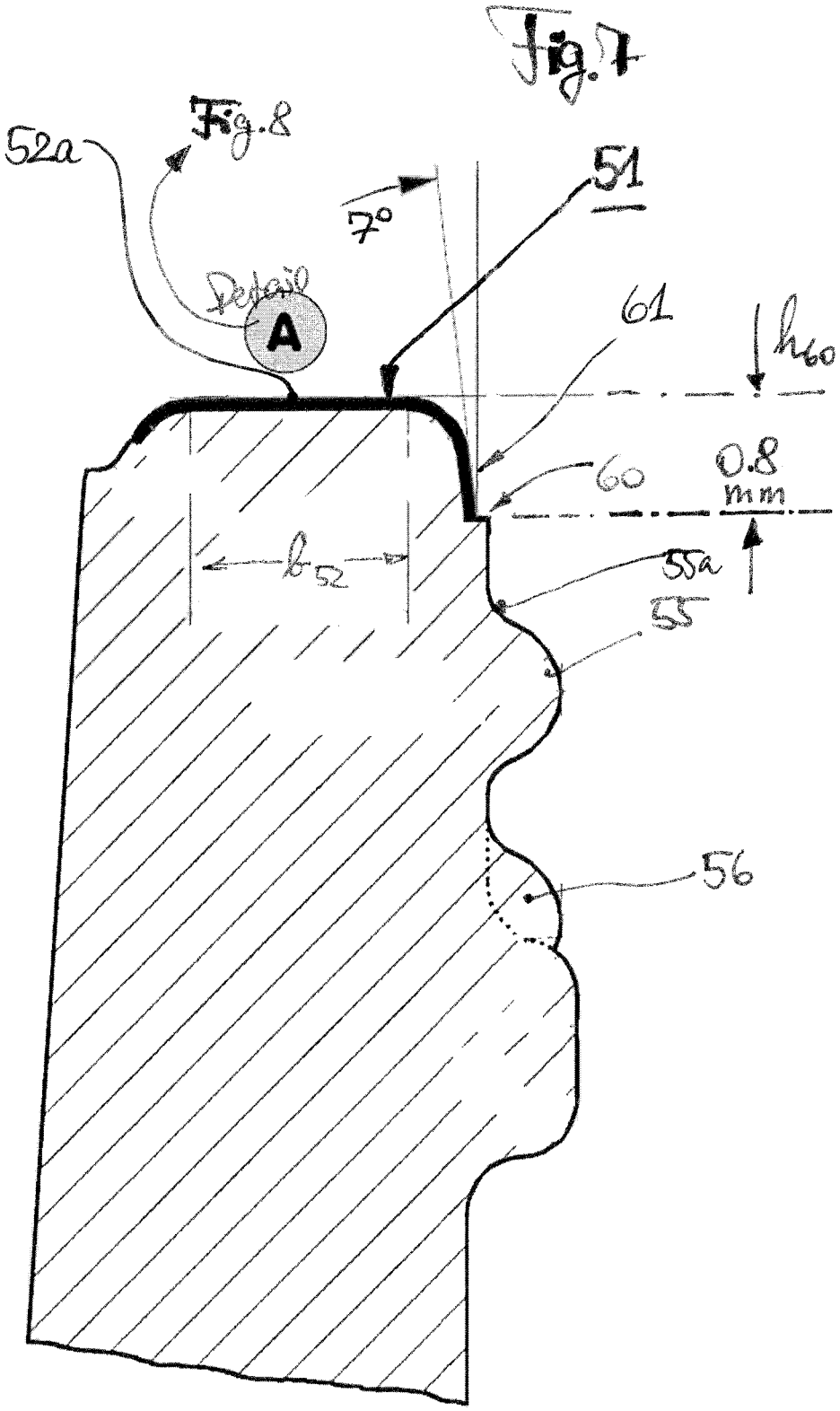

FIG. 7 shows an enlarged section A-A according to FIG. 6.

Figure 3:
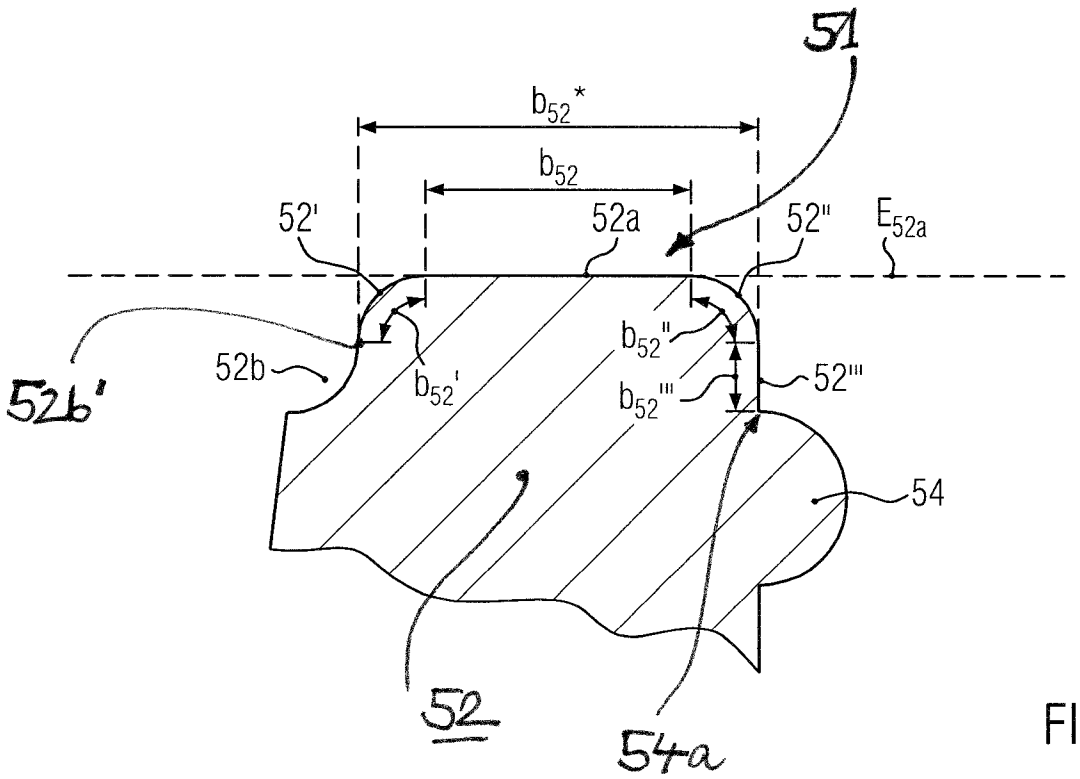
FIG. 3 shows still another enlarged detail representation of the upper end of the mouth area 52 of the glass container, the sealing end face 52*a* representing a connective element that makes FIG. 2 or 1 more easily understandable.

The 3D extension (as 3D annular surface) of the sealing area 51 is visible more clearly, which sealing area was explained in the respective parts of FIG. 3.

Figure 7B:
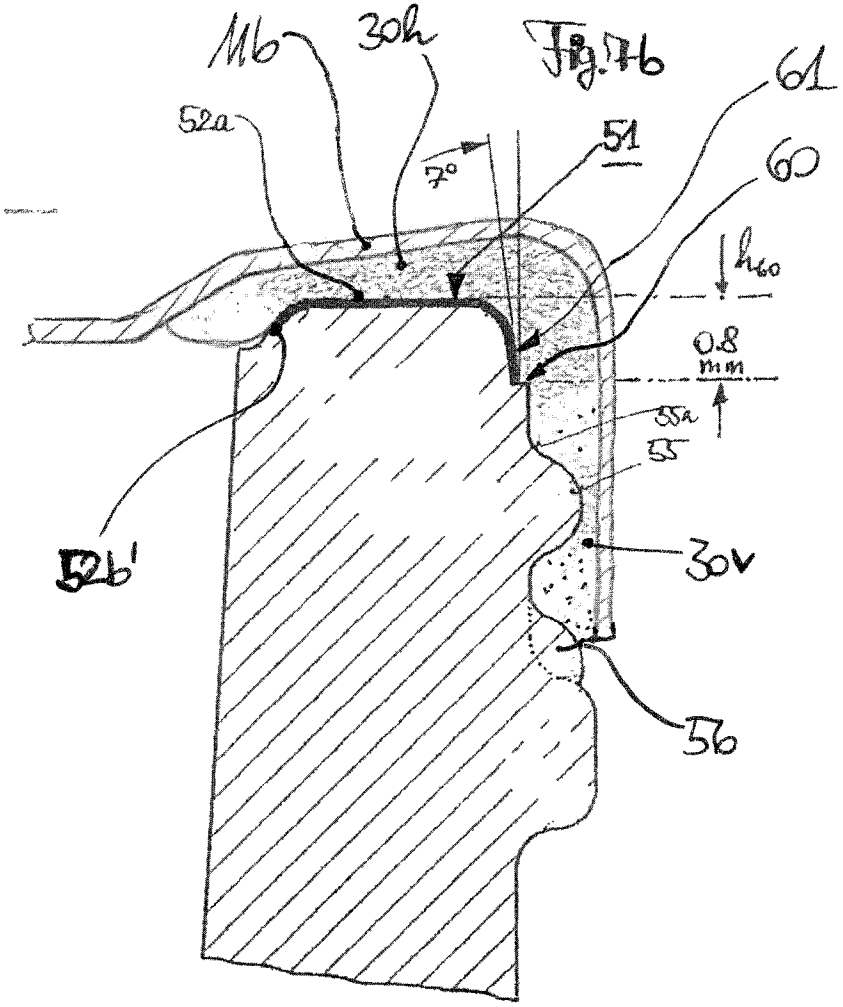
Figure 7A:
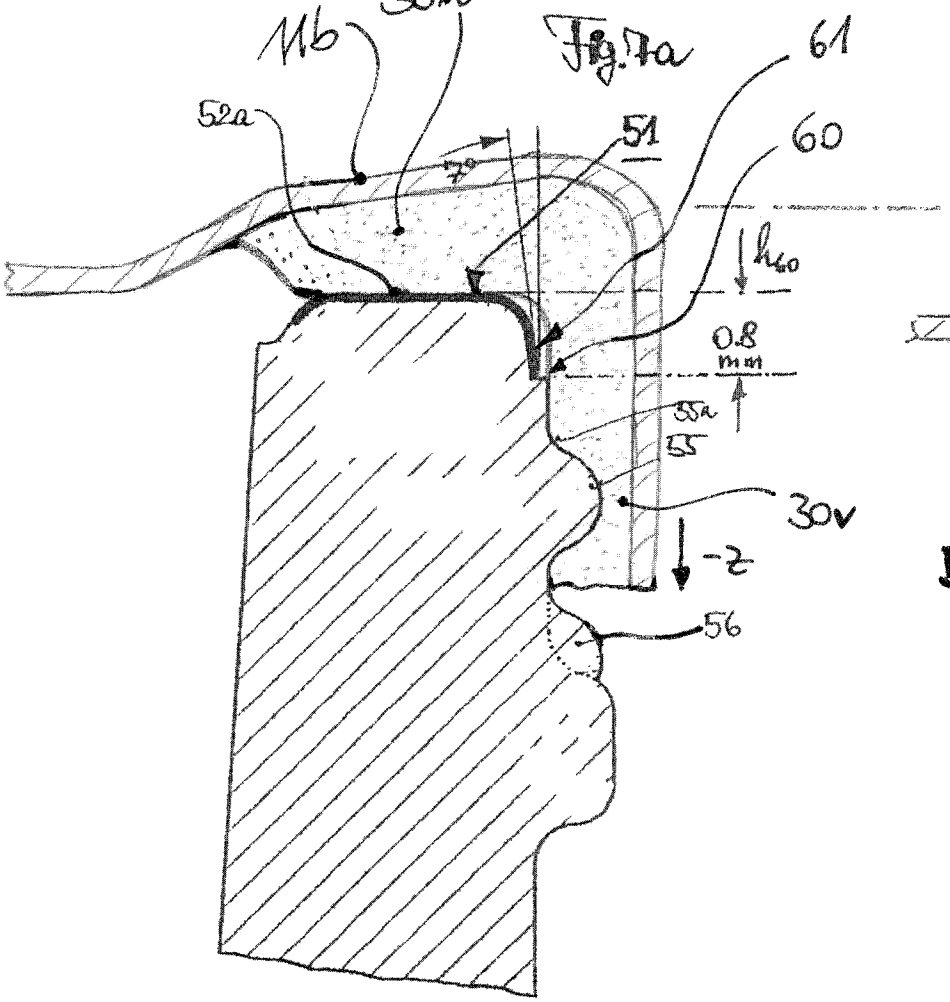
Figure 8:
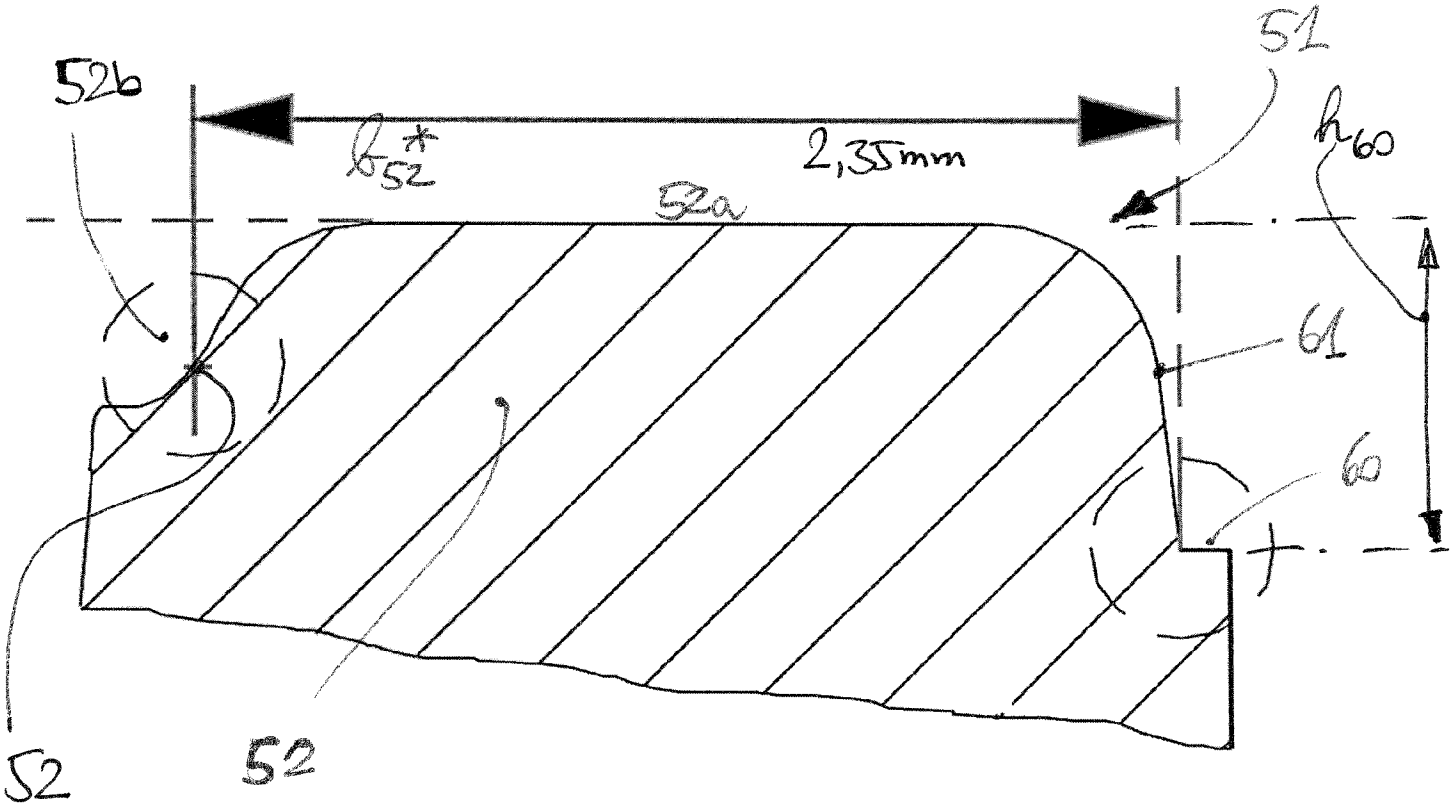

FIG. 7*a* FIG. 7*b* show FIG. 7 with a closure cap (1 or 2 according to FIG. 1 or FIG. 2); this cap has only been placed on top of the container in FIG. 7*a* and has been axially pressed down to a certain extent in the −z direction in FIG. 7*b*, so that the end face 52*a* presses into the horizontal section 30*h* of the plastics layer 30.

FIG. 8 shows a representation of the sealing area 51 with the purely horizontal section 52*a* and with a curved section up to the external, circumferentially extending step 60, which representation has been enlarged once more.

Figure 4:
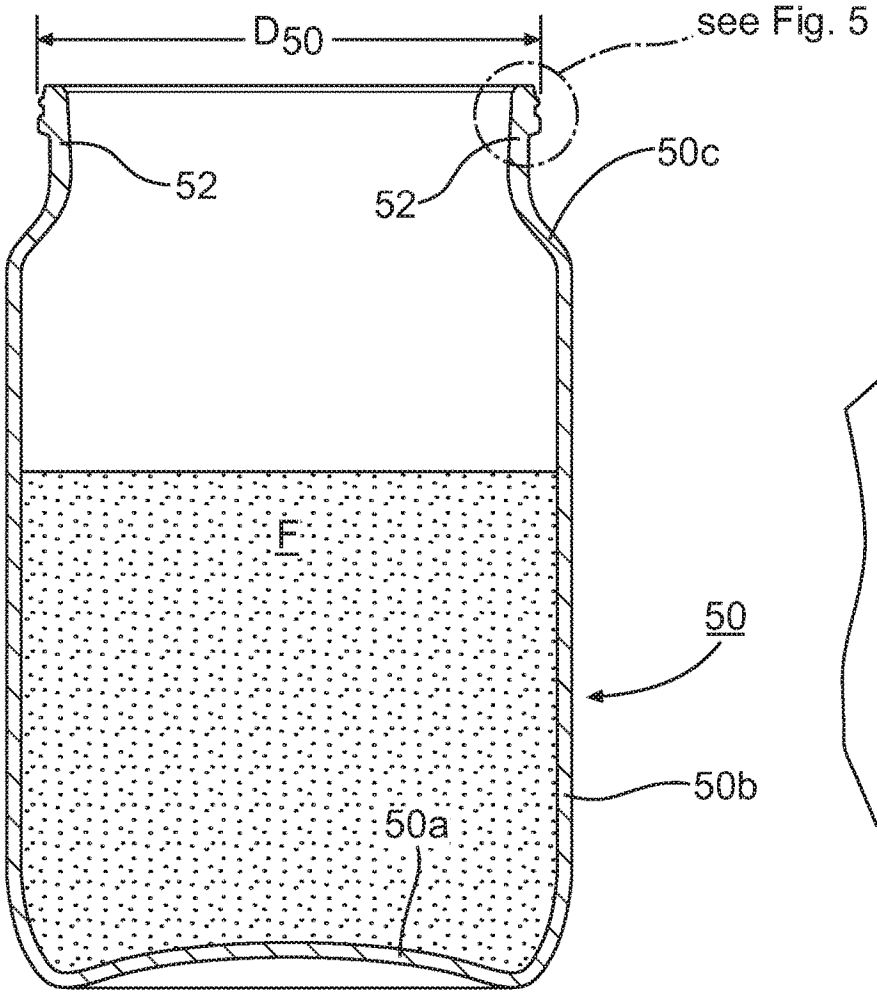
FIG. 4 shows an example of a container in its entirety (e.g. as a glass vessel) 50 in an axial sectional view and with the filled-in product F accommodated therein.

The container 50 according to FIG. 4 is preferably made of glass or hard plastic (hereinafter referred to as "glass container"). It has a mouth area 52 with a diameter $D_{50}$, the mouth area 52 being shown in FIG. 1, FIG. 2 and FIG. 5 in part and in FIG. 3 (as well as FIGS. 6 to 8) in an enlarged representation. The upper end of the container neck (as mouth area 52) of the container 50 is a radially directed end face 52*a* delimited inwards by a circumferential fluted groove 52*b* and outwards by an axial piece $h_{54}$ extending up to the axially upper end of the thread web 54 in FIGS. 1 to 3. Since an axial section is shown, it is evident that this sectional view may stand for any circumferentially further displaced sectional representation, with the exception of the height position of the two thread segments 54, 55 shown, which, depending on the respective circumferential rotational displacement of the vertical section, are positioned on a different height level of the outer surface of the container neck 52.

Figure 1:
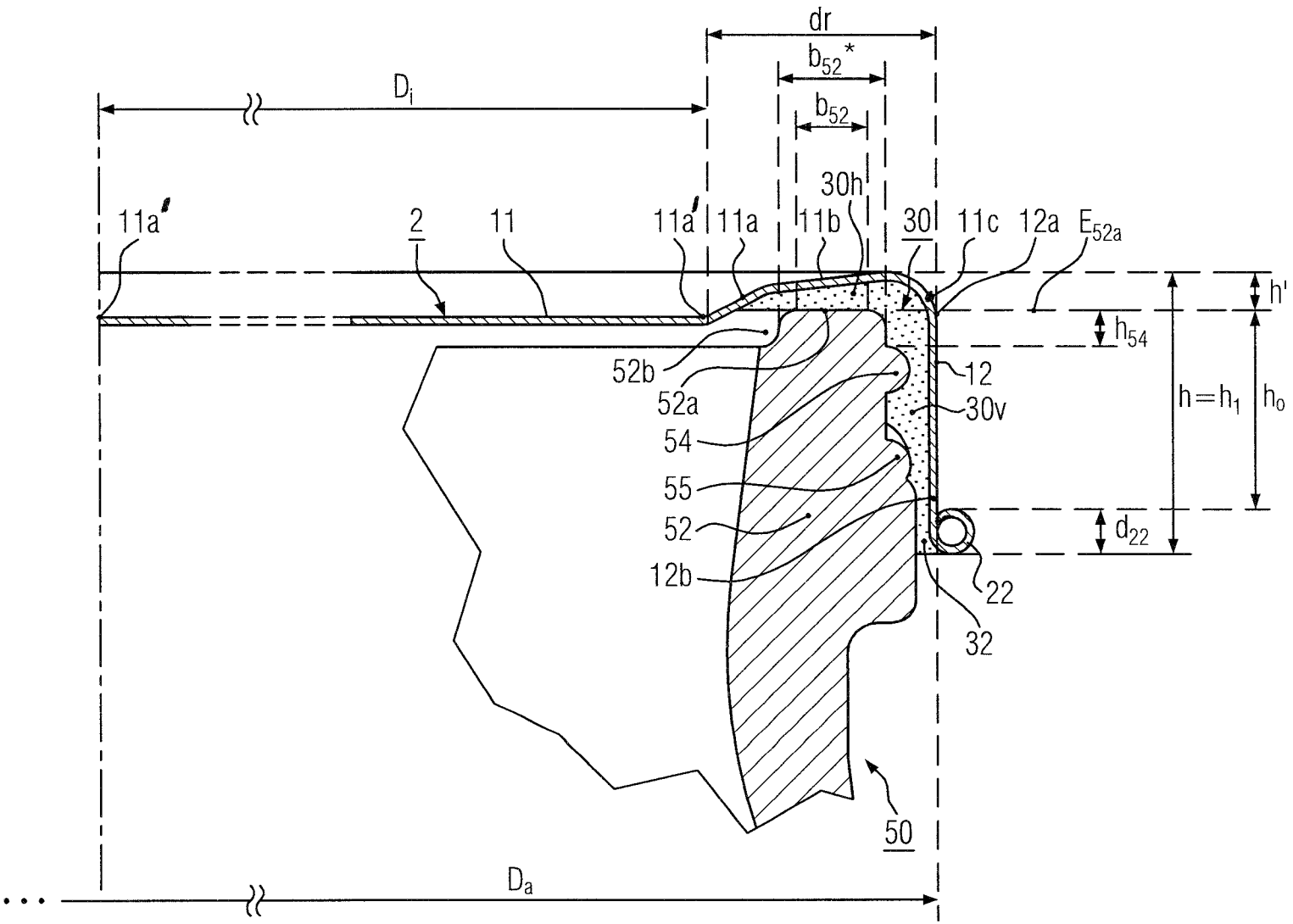
Figure 2:
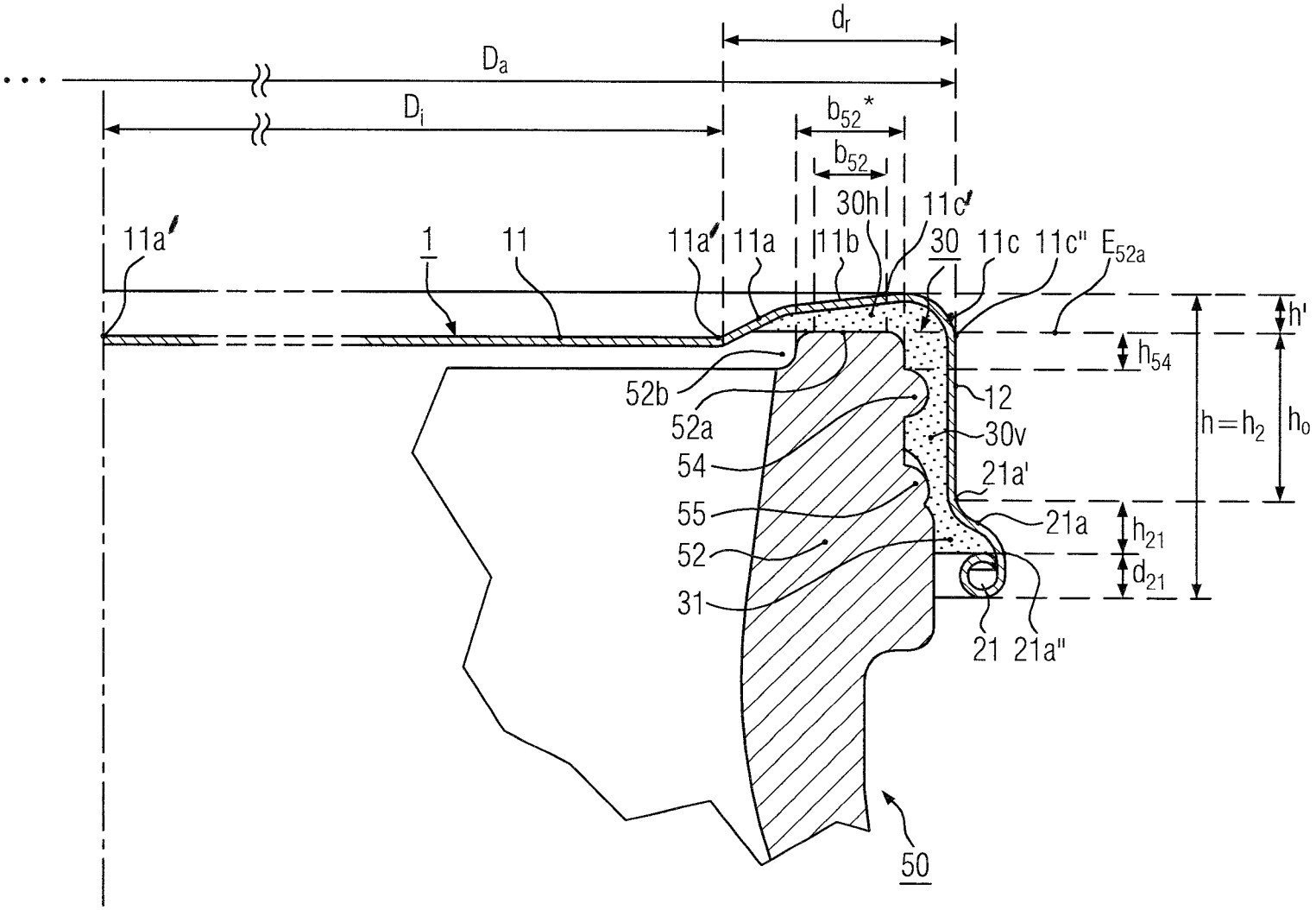
FIG. 2 illustrates another example of a closure cap 1 in the same enlarged detail representation on the same glass vessel 50, again in an axial sectional view.

A product F to be filled in is schematically shown, the product being first filled in and then closed, or intended to be closed by a closure cap 1 or 2 according to FIG. 1 or 2. The filling takes place in a hot or in a cold condition of the product. One of the thermal treatment methods may be used, cf. page 3, second paragraph.

In FIGS. 4 to 8, a step 60 is additionally provided above the thread segments on the container neck 52.

The closure cap 2 in FIG. 1 is only shown in part. Two of its radial dimensions are indicated, $D_i$ and $D_a$. The dimension $D_i$ is the radial diameter dimension of the cap face 11 that may also be referred to as central area. It extends inside a circumferential bend 11*a*' merging with the rim area represented by reference numerals 11*a*, 11*b* and 11*c*.

The external dimension $D_a$ will be described previously. $D_a$ is the diameter dimension of the skirt 12 adjoining the transition zone 11*a*, 11*b* and 11*c* in a radially outward direction but projecting downwards in an axial direction. In the representation according to FIGS. 1 and 2, the left side of the skirt section 12 cannot be seen, so that also the beginning of the external diameter $D_a$ on the left margin remains open, but the diameter dimension $D_i$ can be shown on the left margin according to the circumferential bent line 11*a'*.

The difference between the two diameters $D_a$ and $D_i$ describes by the radial dimension dr, as shown in FIGS. 1 and 2, where $D_a$-$D_i$=2 dr.

The dimension "dr" (in the sense of delta r) comprises, starting at the circumferential bend 11*a*', the first ramp section 11*a*, a slightly less inclined second ramp section 11*b* above the end face 52*a* of the neck 52 of the container 50 and the right outer end of this second ramp section 11*b*, the right outer end merging with the skirt section 12 via a curved section 11*c*.

The upper end of the skirt section 12 in FIG. 1 is designated by 12*a*, and 12*b* stands for the lower end. Between these two ends or end points, the skirt 12 extends straight in an axial direction and defines a cylinder, when seen in the circumferential direction.

Below the lower end 12*b* of the skirt section 12, there is an outward curl 22 which directly adjoins the lower end 12*b*.

In the radial transition section having the radial width dr, a radially directed, horizontal section 30*h* of a sealing layer 30 is arranged, and radially inside of the skirt 12 the axial section 30*v* of the sealing layer made of plastic is arranged.

The circumferentially extending plastics layer comprises these two sections 30*h* and 30*v* and extends down to the curl area 22 in FIG. 1, where it is designated by 32 radially inside of the outward curl 22. This is likewise the case in section 31 above the inward curl 21 in FIG. 2, radially inwards of the expansion section 21*a*.

Some measures of length will here be presented. Their meaning will be explained in more detail hereinbelow.

The plastics layer is 30 or 30*h* (horizontal) with 30*v* (vertical).

The transition zone is 11*a*, 11*b*, 11*c*.

The turning point 52*b*' is in the fluted groove 52*b*.

Staggered thread elements 53, 54, 55, 56, 57, 58 are provided.

The entire extending sealing area above is 51.

The sealing area 51 has a radial dimension of $b_{52}$*.

The horizontally directed end face is 52*a*.

The horizontal end face 52*a* as an annular surface has an annular width $b_{52}$.

The axial distance is $h_{60}$ between the external step 60 and the upper horizontal end face 52*a*.

The ratio $h_{60}/b_{52}$ is smaller than 0.7.

An axial spacing $h_{54}$ is defined, it extends between the axially upper ends 53*a*, 54*a*, 55*a*, 56*a*, 57*a* of the circumferentially offset thread elements 53, 54, 55, 56, 57 and a horizontal plane $E_{52a}$.

The plane $E_{52a}$ is defined by the horizontally oriented end face 52*a* of the container neck 52 of the glass container 50.

The second axial distance is $h_{60}$, this being the distance between the upper horizontal end face 52*a* and the outwardly directed step 60.

$h_0$ is the axial extension of the skirt section 12 of the closure cap 1 or 2.

dr is a radial extension of the transition zone 11*a*, 11*b*, 11*c*.

As regards the dimensions, more detailed comments will be made hereinbelow. First, it will be shown that the closure cap 2, which has been pressed on by axial pressure, has not yet been fully pressed on in FIG. 1, since the horizontal section 30*h* of the plastics layer is not yet compressed. The horizontal section 30*h* only rests on the end face 52*a*, but is, in reality, compressed to a certain extent by the upper end face 52*a*, so that the horizontal section 30*h* of the sealing layer extends beyond the initial sealing area 52*a* also into areas visible in FIG. 1 on the left and on the right hand side with a radius of curvature (edge chamfering). On the left hand side of FIG. 1 or FIG. 2, the radial compound section 30*h* extends to a certain extent into the fluted groove 52*b*.

This can be seen in the enlarged representation according to FIG. 3. This FIG. 3 can be taken into account in connection with the embodiments according to FIG. 1 and FIG. 2.

FIG. 3 shows the upper edge of the neck 52. The horizontally oriented end face 52*a* having a width $b_{52}$ may serve as a connection element. It is oriented fully horizontally and defines a horizontal plane $E_{52a}$ with respect to which reference dimensions and ratios will be explained hereinbelow.

On the left and on the right hand side of the horizontally oriented end face 52*a*, there are radii of curvature determining a curvature 52' and 52" (as arc section). The respective length associated therewith is $b_{52'}$ and $b_{52''}$.

It goes without saying that these areas or elements extend circumferentially and that the concept of radial dimension must be considered exclusively from a radial point of view. The length $b_{52'}$ is e.g. longer than the pure radial dimension that is added to the radial dimension $b_{52}$ on the inner side. The latter extends up to the turning point of the fluted groove 52*b* (the "turning point" in section is a circumferential line when seen in the circumferential direction).

At the outside, a further, almost axially extending section 52'" can additionally be seen, which extends up to the thread segment 54. In the example according to FIG. 3, this dimension is very short in comparison with the arc 52" having the actual length $b_{52''}$, but it only supplements a much smaller radial dimension that complements the purely radial dimension $b_{52}$, taking into consideration the entire extending sealing area 51 that has a purely radial dimension $b_{52}$* and a purely horizontally oriented end face 52*a*.

This is the radial dimension of the effective sealing area 51. The effective sealing area 51 itself may, however, be definitely longer. The purely horizontally oriented and purely radially extending end face 52*a* is therefore more precisely dimensioned with the purely radial dimension $b_{52}$.

As regards the sealing, the sum of the area sections $b_{52}$, $b_{52'}$, $b_{52''}$ and $b_{52'''}$ is of decisive importance, the section 52'" extending practically purely axially and a piece thereof being also radially oriented with a very small angle of inclination. The last-mentioned section 52'" ends, in the present example, at the upper end of the thread segments. Here for the dimension at the upper end of the thread web or of all the circumferentially extending thread webs 53, 54, 55, 56 etc. and also of additional ones, which are not shown in FIG. 6.

The understanding of FIG. 3 will be transferred to FIGS. 1 and 2 in the following, but the inward curl 21 of the closure cap 1 in the case of the example according to FIG. 2 will be explained previously.

This inward curl 21 adjoins the skirt section 12, the other elements and functions being used in a way corresponding to that which has been explained in connection with FIG. 1. The respective associated reference numerals are identical as well.

The lower axial end of the cylindrical skirt section 12 does not terminate directly in a curl, but in an expansion section 21*a*. The upper end 21*a*' of the latter adjoins the lower end of the cylindrical section 12. The lower end 21*a*" of the expansion section 21*a* merges with an inwardly rolled section 21 defining one complete turn. The indication of the diameter $d_{21}$ can define the curl 21, and the height $h_{21}$ defines the height of the transition section 21*a* that serves the purpose of radial expansion and the provision of space for the inward curl.

Radially inwards of the expansion 21*a*, a plastics area 31 is provided, which extends also below the axial lower end 12*b* according to FIG. 1, here in FIG. 2, and expands there in a radial direction. It does, however, not extend axially beyond the inward curl in a downward direction, but is limited to the height $h_{21}$. The height section $d_{22}$ of the outward curl 22 according to FIG. 1 can be referred to analogously, this height section defining a comparable plastics area 32.

The findings according to FIG. 3 will now be transferred to FIGS. 1 and 2.

In FIG. 1, the radial dimension of the end face 52*a* has the dimension $b_{52}$. The effective sealing area is broader and, especially in the radial direction, also longer, but the effective sealing area does not have a dimension corresponding to the actual "length" thereof, but its dimension is the depicted dimension $b_{52}$*. These two dimensions have been explained in FIG. 3 and are shown in each of FIGS. 1 and 2 below the second ramp section 11*b* that is positioned above the end face 52*a* providing the initial sealing effect.

The radial dimension dr of the transition zone 11*a*, consisting of the three elements 11*a*, 11*b*, 11*c*, is depicted in both FIG. 1 and FIG. 2. It is larger than the axial height of the cylindrical skirt section 12. This height has the dimension $h_0$. It begins at the upper end 12*a* of the skirt section 12, which corresponds to the radial outer end 11*c*" of the curved section 11*c*. The inner end 11*c*' of the curved section 11*c* merges with the second ramp section 11*b*.

$h_{54}$ is positioned approximately on the level of the outer surface of the upper end of the container neck 52 and extends between the upper end of all threads (of a respective imaginary circumferential line) and the plane $E_{52a}$ defining the position and the orientation of the horizontal end face 52*a* or vice versa.

The spacing of the plane $E_{52a}$ from the upper end of the thread segments 54 (and with a corresponding circumferential displacement also of the segment 55) is specified as $h_{54}$. This dimension is particularly short. It allows a prior art dimension, which is much higher and which amounts to more than 2.8 mm, to be reduced substantially in the embodiments according to FIGS. 1 and 2. This spacing $h_{54}$ will be referred to as a threadless zone between the end face 52*a* and the thread area consisting of the plurality of circumferentially offset thread elements 54, 55.

In the embodiments, this height dimension $h_{54}$ is definitely smaller than 2 mm, preferably smaller than 1.6 mm, or even substantially 1.3 mm, which stands for the very small size of this dimension in the axial direction. This is an axial section of the container neck of substantially reduced length, which does not comprise any thread elements and which substantially contributes to the sealing effect in the prior art. These thread elements are no longer provided according to the embodiments of the present invention, although these embodiments still produce a sufficient sealing effect.

Another dimension is the radial dimension dr in relation to the specified axial height $h_0$ of the skirt section 12. These two dimensions are here in the same order of magnitude, or the height dimension becomes smaller than the radial dimension.

The radial dimension is significant for the sealing effect on the end face of the mouth. The axial dimension is significant for the opening mechanics.

This radial dimension may here be the radial dimension dr of the sheet metal cap and consists of the three sections 11*a*, 11*b* and 11*c* in the transition zone, or it may be the above described radial dimension 52*a* on the glass, which establishes the initial sealing contact and defines the plane $E_{52a}$. The latter is on the container, the former is on the closure cap.

The ratios are such that, in an example of the outward curl of FIG. 1, the height dimension $h_0$ can be specified as 4.405 mm. In the case of a cap having an external dimension of 60 mm this has to be related to a dr of 4.48 mm. The resultant ratio $v_2$ of axial height of the skirt to radial extension of the transition zone is 0.98.

This ratio $v_2$=0.98 for characterizing a skirt having very short axial dimensions may have a tolerance range of ±2%.

The respective dimensioning and determination of assignment may also take as a basis the radial dimension $b_{52}$. In this case, the outward curl 22 according to FIG. 1 has an axial height dimension of the skirt 12 according to FIG. 1 of $h_0$=4.405, as specified above. The dimension used for the container 50 in the neck section 52 is $b_{52}$=1.5 mm. This comparatively narrow dimension is supplemented by the additional dimensions specified in FIG. 3, which define the effective sealing area, so that the radial dimension of the effective sealing area is given by $b_{52}$*, which amounts to 2.35 mm, the pure radial dimension of the end face 52*a* being, however, only 1.5 mm within this dimension $b_{52}$*.

In the example according to FIG. 1 comprising an outward curl, the ratio $v_1$ of axial height to the pure radial dimension $b_{52}$ is thus calculated from the above values as 2.94 and is smaller than 3.00. The other ratio for the inward curl according to FIG. 2 is that of the height dimension $h_0$ to the extension $b_{52}$ of the end face 52*a*. The dimension $b_{52}$ is here equal to that of the example according to FIG. 1 and amounts to 1.5 mm.

For the embodiment of the inward curl 21 according to FIG. 2 also a comparatively short skirt section 12 can be described by ratios, in one case through the first ratio $v_1$ and in another case through the second ratio $v_2$, or through the combination of these ratios. The first ratio $v_1$ describes the ratio of the length (of the skirt section) to the horizontal end face 52*a* on the glass container; the second ratio $v_2$ describes the ratio $h_0$ to the radial extension dr of the transition zone 11*a*, 11*b* and 11*c* on the closure cap alone.

It is to be expected that other diameters of closure caps, not only that of the 60 mm closure cap, will also exhibit these ratios $v_1$ and $v_2$, since the width 52 of the sealing zone to the length of the axial retaining zone as well as dr and $h_0$ remain virtually unchanged for closure caps having smaller and larger diameters.

Also in this case, the axial section $h_0$ is shorter than the radial dimension dr for the closure cap. According to the example in question, the height $h_0$ for FIG. 2 is to be specified as 4.005 mm and the radial extension dr is to be specified as 4.48 mm, as in the case of the example according to FIG. 1.

From the above, a FIG. 2 ratio $v_2$ of 0.89 is obtained, i.e. a ratio that is even smaller than the FIG. 1 ratio $v_2$ of 0.98 explained on the basis of the example according to FIG. 1.

This ratio can, in a larger tolerance range, be specified as 0.9±5%, so can 0.89±1%, shown on the basis of the example of a 59 mm closure cap in FIG. 2, this diameter dimension $D_a$ being, however, not of essential importance for the ratio described, since in the mouth area of the closed container 50 this ratio remains the same, virtually independently of the diameter of various closures.

On the one hand, it is possible to specify an upper limit having the effect that this second ratio $v_2$ will be smaller than 1, but also a lower limit can be specified, according to which the ratio should be larger than 0.85. In the case of a technical-functional limitation, this should always be described by an upper and a lower limit. However, it is primarily the upper limit that is significant for a differentiation from the prior art, since the small dimension of the axial extension of the skirt 12 can be described best by the upper limit.

It follows that, in the example according to FIG. 1 comprising an outward curl, the ratio $v_1$ of the axial height to the pure radial dimension $b_{52}$ is 2.94 and, consequently, smaller than 3.00. The other ratio for the inward curl according to FIG. 2 is that of the height dimension $h_0$ to the extension $b_{52}$ of the end face 52*a*. The dimension $b_{52}$ is here equal to that of the example according to FIG. 1 and amounts to 1.5 mm.

Also the radial dimension $b_{52}$* of the effective sealing area remained here the same and is specified as 2.35 mm. This is evident, since both glass containers 50 are to be assumed as being identical, in one case closed with a closure cap 2 having an outward curl 22 and in another case closed with a closure cap 1 having an inward curl 21, in either case at the lower end of the skirt section 12.

In view of the low height of 4.005 mm of the axial skirt section 12, a smaller first ratio $v_1$ of 2.67 is obtained. Also this ratio lies below the upper limit of 3.0 and, specified more precisely, it can be indicated as lying below 2.70.

In the examples of FIGS. 1 and 2 other height dimensions are additionally shown, which result from the height dimensions described.

The height dimension $h=h_1$ for the skirt with the outward curl 22 according to FIG. 1 is composed of three components, the diameter $d_{22}$ of the rolled-in area 22, the axial height $h_0$ of the "short" skirt section 12 and an axial height h' of the transition zone 11*a*, 11*b* and 11*c* having the radial width dr. The resultant overall height of the rim area of the closure cap 2 is here $h_1$.

FIG. 2 discloses a further component $h_{21}$ of the closure cap 1 with the inward curl 21, in addition to the above described three components according to FIG. 1, here for the formation of the height dimension $h=h_2$. Hence, the three components are, accordingly, the axial dimension $h_0$ of the skirt 12, the diameter $d_{21}$ of the inward curl 21 and the axial height dimension h' of the transition zone 11*a*, 11*b* and 11*c*, which can be taken from FIG. 1. The newly added axial dimension $h_{21}$ is the axial height of the bell-shaped, expanded intermediate section 21*a* with its lower end 21*a*".

The container according to FIG. 4 is closed at the bottom and has a mouth area 52, which is open at the top and which will often also be referred to as "mouth" in the following. The upper end of this mouth defines a sealing area 51, which is configured as a three-dimensional annular surface and which will be specified more precisely in the enlarged representations of details in the following.

The mouth area 52 of the container is provided with an upper sealing profile (as three-dimensional sealing area 51) and has a thread profile arranged therebelow, the thread profile consisting of the thread segments 53, 54, . . . . FIG. 6 shows these thread segments unrolled into a plane, only one hemisphere, i.e. 180° of the mouth area, being shown unrolled into a plane. Preferably, between six and ten thread segments in a 4 cm to 7 cm range of diameters of the container 50 are provided on a circumference of 360°. What can be seen on the present representation are four complete thread segments and two half segments 53 and 58 on 180°.

The shape of the container is shown in an example in FIG. 4. The container comprises a substantially cylindrical body part 50*b*, followed, at the lower end thereof, by a slightly vaulted bottom part 50*a*, and above the cylindrical body part 50*b* a constriction 50*c* is provided, whose upper end merges with the above-mentioned mouth area 52.

Also a great variety of other shapes of closed bodies may be used, some of them having no constriction, others having a flat bottom, and a cylindrical body part 50*b* need not necessarily be provided. This example according to FIG. 4 only singles out one possible example and emphasizes, in the following description, the mouth area 52 being configured for attachment to a basic body (container body) of arbitrary shape or for being adjoined to the top of the latter.

The material of the container is preferably glass. Also a dimensionally stable plastic may be used, elastic deformations of the container should be avoided, so that neither flexible plastic materials nor formed carton can be used, when a dimensionally stable neck 52 is to be provided as a mouth area.

Figure 5:
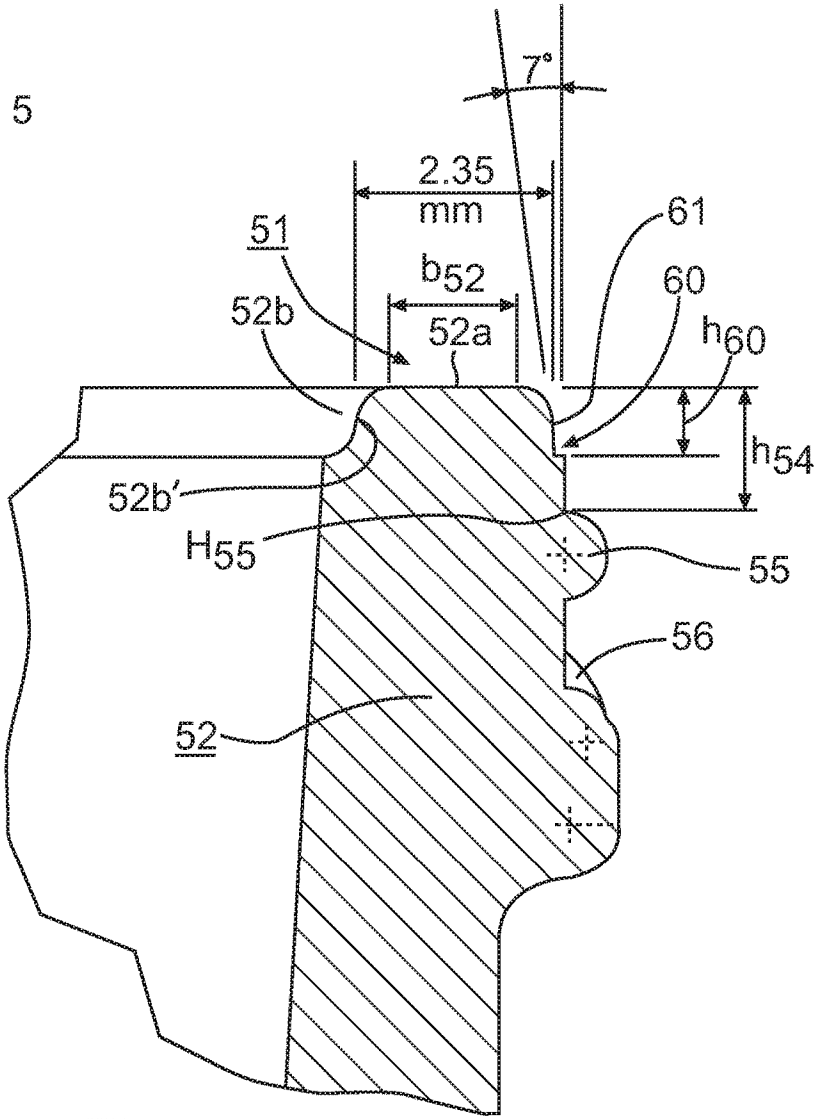
FIG. 5 shows a detail of the mouth area 52 of FIG. 4.

FIG. 5 shows an enlarged representation of a detail of FIG. 4. The sealing area 51, a more precise embodiment of which has been explained in FIG. 3, can here be seen in more detail. An additional step 60 is added, which, as regards the glass body 50, slightly modifies the embodiment according to FIG. 5 in comparison with the examples according to FIG. 1 FIG. 2.

The upper end of a thread element 55 is shown in a sectional view, the step 60 being positioned axially above this thread element 55 and, again axially above, the three-dimensional sealing area 51 is provided, which begins at step 60 (on the outer side) and extends up to the turning point 52*b*' of the fluted groove 52*b* on the inner side of the mouth 52 (as a lateral groove that is open at the top).

In the example according to FIG. 5, a slight inclination of substantially 7° of the almost axial section 61 can be seen. The curvatures 52" and 52' can be adopted from FIG. 3, so can the horizontally oriented annular surface 52*a*, which defines a portion of the sealingly effective area 51. Its width in the radial direction is $b_{52}$.

FIG. 5 shows a subsequent thread element 56. The section A-A according to FIG. 6 can here be assumed to be shown.

Below the thread profile of all thread elements, among which elements 53 to 58 are shown in FIG. 6, there is a stabilizing thickened portion of the class container, up to which also the axially lower end section of the closure cap shown in FIGS. 1 and 2 extends. This lower end section may have an outward curl or an inward curl, as has been explained in connection with FIGS. 1 and 2.

The above-mentioned thread elements according to FIG. 6 are partially overlapping, they extend at a slightly upwards directed inclination angle $\alpha$ of 4.5° to 5° and, due to their staggered arrangement, they accomplish the effect of a continuous thread, which would be impossible to position on such a short height of the mouth section 52. In addition, they allow the effect of pressing on a closure cap having a plastics layer arranged on the side of the inner rim thereof, the plastics layer consisting of a vertical and a horizontal section. When the closure is being pressed on, the vertical section comes into contact with the thread segments and forms paths by impression. Along these paths, the closure cap can axially be lifted off when it is being unscrewed. The latter is done on the part of the user or by the user or the person handling the closure cap, the former takes place when the container is being closed through or by the filler.

FIG. 6 explains the position of the external step 60 that can be seen from FIG. 5. The step 60 is positioned slightly above the upper ends of the thread elements, which, in the following, will be described, inherently, by the term thread segments as being staggered, delimited in length, circumferentially offset relative to one another and slightly inclined.

The upper horizontal sealing area 52*a* is, in FIG. 6, the upper end of the container neck unrolled into a plane, the container neck having the thread profile. The spacing of step 60 from this upper end is smaller than the axial dimension $h_{54}$. This section from step 60 up to the horizontal section 52*a* of the sealing area 51 is designated by 61 and corresponds analogously to the two sections 52" and 52'" according to FIG. 3, where no step 60 is provided.

The thread segments, which are shown in FIG. 6 in a representation unrolled into a plane, are shown more clearly on the basis of the enlarged representation of a detail according to FIG. 6*a*. Here, it will be explained, with respect to a thread segment 55, what the axial upper end of this thread segment is. This explanation applies, however, equally to all thread segments. The end of the thread segment is designated by 55*a*'. The axial upper end is designated by 55*a*, when seen in a purely axial direction of view. It defines a circumferential height dimension or a circumferential line $H_{54}$ serving as a determination base. It extends parallel to the circumferential profile of step 60 and parallel to the upper horizontal sealing area 52*a*.

In the following, it will be explained by the parameters described that the upper axial ends of the thread segments 53, 54, 55, 56, 57, 58 and of all the thread segments located on the other hemisphere, which is not shown in FIG. 6, approach the step 60 very closely and are therefore also located in very close proximity to the sealing area 51.

In other words, the step 60 of the embodiments according to the present invention shown in FIG. 5 is located very close to the axial upper ends 53*a*, 54*a*, 55*a*, 56*a* and 57*a* as well as to all those axial upper ends located on the other 180° of the container mouth, which is not shown in FIG. 6.

In the embodiments according to FIGS. 1, 2 and 3, the step 60 does not exist, as can especially be seen in the case of the embodiments according to FIG. 3. Instead, the sealing area 51 with both external sections 52" and 52'" is configured to extend up to the upper end (the axial upper end 54*a* in the representation according to FIG. 3).

It follows that, in the case of all embodiments, with or without a step 60, the defined axial upper end $H_{54}$ of the thread area approaches the sealing area 52 very closely, in other words particularly closely to such an extent that the term short neck is an appropriate term to use. This short neck may also be described by other terms as being reduced in length, compact or by a combination of these terms.

However, a particularly short or compact and/or length-reduced structural design of a neck can only be described in comparison with the prior art. Such a comparison is, however, difficult to express in a claimed subject matter, so that it is necessary to make use of orders of magnitude or magnitudes, in connection with which the dimensional lines or dimensional planes have been described hereinbefore, which will be filled hereinbelow with informative content by specifying dimensional and proportional data with respect to spacings or ratios of lengths or widths.

The first dimension of this height reduction of the mouth area 52 is explained in FIG. 5. Here, the step 60 is spaced from the horizontal section 52*a* of the sealing area 51 by a distance of approx. 0.8 mm.

When seen from the reverse point of view, the step 60 is spaced from the upper axial end of the thread segments by a similar dimension, viz. by 0.7 mm.

The radial width of the entire sealing area 51 amounts to approx. 2.35 mm and is composed of the various sections that can be seen from FIG. 3. The purely radially directed dimension $b_{52}$ amounts to approx. 1.5 mm (the horizontal end face 52*a*).

When a closure cap according to e.g. FIG. 1 or 2 is placed onto the mouth area 52, the sealing area 51 is dimensioned such that it is formed by impression. This three-dimensional sealing area extends from the turning point 52*b*' of the fluted groove 52*b* to the external step 60. This corresponds to an approximate extension into the depth direction of 80% to 90% of a horizontal section 30*h* of the plastics layer 30 (comprising the horizontal section 30*h* and the vertical section 30*v*) positioned on the cap. The order of magnitude of this plastics layer is normally in the range of 1 mm, so that pressing in and a pressure—resulting from such pressing in—will occur, whereby the food content of the container 50 will be sealed reliably.

The positioning of the step 60 and the dimensioning of the short neck 52 also allow various other geometries and dimensions, in the case of which the step still exists, or does not exist, as is the case with FIGS. 1 and 2 and the container neck 52 shown there. What is referred to here is the "threadless" height $h_{54}$, which describes an axial section of the container neck 52 having neither any thread nor any thread segment provided thereon. Hence, it will be assumed in the following description that the upper end of each of the segments is the lower end of the height dimension $h_{54}$. The upper ends of the segments are located on a circumferential line $H_{54}$.

The circumferential line $H_{54}$ according to FIG. 6 illustrates that which is shown in FIG. 5 in a sectional view.

If the person skilled in the art intends to choose the definition of the short neck such that a ratio is defined, i.e. to consider a width $b_{52}$ of the horizontal section of the sealing area 51 and the axial spacing $h_{54}$ that is independent of the existence of a step 60 (the step being positioned at the outside and being therefore also "directed outwards"), this will result in the reflection following hereinbelow.

The axial spacing is defined between the axial upper ends of the (of all) segments and a horizontal plane. This horizontal plane is a working hypothesis that is intended to describe the horizontally oriented end face 52*a* of the container neck 52. Between this plane and the imaginary circumferential line $H_{54}$ a spacing is defined. This spacing is to be related to the width $b_{52}$ necessary or required for the sealing effect, so that a ratio is obtained that is capable of equally expressing the performance or function of sufficient sealing and the performance or function of the comparatively short axial length of the mouth area 52.

This ratio is less than 1.35, even in modified embodiments following the embodiment of FIG. 5 or the stepless structural design of FIGS. 1 and 2 with respect to the container. The height $h_{54}$ does here not exceed 2 mm, and may vary around the depicted example according to FIG. 5 with $h_{54}$=1.5 mm and may also be smaller than that. Tests have been conducted with $h_{54}$=1.6 mm and $h_{54}$=1.3 mm, i.e. with values slightly above and below the depicted spacing according to FIG. 5. The non-depicted examples, up to $h_{54}$=2 mm at the most, are to be understood as having been made comprehensible to the person skilled in the art according to the embodiment of FIG. 5.

When the person skilled in the art assumes a radial dimension of 1.5 mm in the case of a horizontal sealing area $b_{52}$, a ratio of approx. 1.0 is obtained in the embodiment shown.

The step 60 may additionally be provided and is suitably positioned in the spacing $h_{54}$ such that preferably up to this step the horizontal section of the plastics layer 30 will be sealingly pressed into, when the cap is placed onto the glass 50 by being pressed on mechanically at the filler's.

In the case of higher $h_{54}$ values of up to 2 mm, the step 60 may also be positioned such that this closure sealing is established by pressing-in under pressure, thus forming the "seal" by the sealing area 51 shown in FIG. 7 more precisely and in more detail. The step 60 may, however, also be positioned such that it is located closer to the axial upper ends (the circumferential line $H_{54}$), so that it will not necessarily press into the horizontal section of the plastics layer, but into a piece of the vertical section 30*v* of the plastics layer 30.

The smallest hitherto tested dimension with respect to the axial spacing $h_{54}$ is 1.3 mm, which, related to the assumed width $b_{52}$=1.5 mm, results in a ratio of approx. 0.9 (more precisely 0.867). The here specified ratios are rounded values. The respective specified width and height dimensions have been measured precisely.

A dimension taken from FIG. 5 is illustrated in FIG. 7. A detail of this FIG. 7 is shown in FIG. 8 in a representation that has been enlarged once more.

The step 60 shown there is spaced apart from the horizontal surface 52*a* at a spacing $h_{60}$. The height dimension $h_{54}$ is here not shown. When a step 60 is provided, its spacing or its positioning between the surface 52*a* and the axial upper end of the thread segments, in the present example 55*a*, may also be used for characterizing the short structural design of the neck. Preferably, the step 60 is positioned such that it does not come to lie outside a plastics-layer horizontal section to be attached. In other words, a sufficient amount of material has been removed from the neck 52 for still making the step 60 press into this horizontal section or for still producing the sealing effect in the horizontal section up to this step 60, and the thread segments thus closely approach this step 60. In other words, they will also approach the sealing area 52*a* very closely, so that the neck is compact, short or length-reduced in shape, of course in comparison with the prior art, but here concretely described by the positioning of the step 60 in the threadless section axially above the thread segments (above $H_{54}$).

This definition is here specified as 0.8 mm and may be considered in addition to the definition of the maximum spacing dimension $h_{54}$ or it may be characterized alone. Likewise, the spacing dimension $h_{54}$ alone may be characterizing for the short dimensions of the mouth area (of the neck 52), without taking the position of the step 60 additionally into account.

In the present embodiment, the dimension $h_{60}$ is less than 1 mm. In the preferred design of the very short neck according to FIG. 5, this is an axial dimension of $h_{60=0.8}$ mm. If a ratio is calculated as a fourth ratio also in this case, the dimension $h_{60}$ and the width $b_{52}$ can be taken into account, which are both values that are representative of the sealing behavior and the shortness of the neck.

With the two represented dimensions smaller than 1.0 mm and smaller than 0.8 mm, or equal to the specified magnitude for $h_{60}$, an upper limit of the ratio of not higher than 0.7 (rounded from 0.67) and not less than 0.55 (rounded from 0.53) is obtained. This is based on a width of 1.5 mm of the radial part (also: purely horizontal part 52*a*) of the sealing area 51 forming three-dimensionally.

As has been described above, this dimension is an additional possible characterization, but not an exclusive characterization. Hence, the two above-mentioned characterizations should not or must not be interpreted such that they must always occur together. For example, a step 60 may be provided, in the case of which $h_{60}$>1.0 mm, but the axial spacing $h_{54}$ is still less than 2 mm, or, expressed in a ratio to the radial extension of the horizontal section of the sealing area 51, less than 1.35 (calculated from a spacing of 2.0 mm between the axial upper ends of the thread segments and a radial width of 1.5 mm as well as rounded up from 1.33 to a handier value of 1.35).

The additional representation of an enlarged detail according to FIG. 8 illustrates that which has been said in the preceding figures. The turning point 52*b*' in the fluted groove 52*b* is clearly visible. The effective radial dimension $b_{52}$* is explained in FIG. 3 and is here applied to the container 50 having an external step 60. The dimension $b_{52}$* is measured up to the inner edge of this step 60 (it also has an outer edge located further out) and in the present example it amounts to 2.35 mm with a certain tolerance that can be specified in the order of ±10%.

The horizontal part of the entire sealing area 51 is 52*a* with a width $b_{52}$ of 1.5 mm, again with a correspondingly specified tolerance.

The attaching of the closure cap (cap 1 or 2 of FIGS. 2 and 1, respectively) is shown in FIGS. 7*a* and 7*b*. FIG. 7*a* shows an initial state of closure cap attachment, where the closure cap has already reached the first thread segment with the vertical section 30*v* of the plastics layer. The horizontal section 30*h* of the entire plastics layer 30 rests on the horizontal end face 52*a*. The sealing area 51 formed after pressing-in is illustrated in FIG. 7*b*. The cap has been pressed-in downwards, the compressed zones of the plastics layer 30 being identified by more closely spaced dots, and, forming small bulges, the sealing material 30 is displaced in the horizontal section to the left and to the right. The substantially vertically oriented section 61 of the sealing area was initially positioned in spaced relationship with the section 30*v* of the plastics layer 30. After the pressing-in, this spacing is occupied by horizontal components of the horizontal section 30*h* due to displacement. The radially inner end has provided therein the laterally oriented groove 52*b* that accommodates the inner bulge formed due to the displacement.

Due to the slope of the transition area of the closure cap, the remaining spacing at the inner edge region of the sealing area 51 is smaller than at the outer edge region. A complete pressing down of the closure cap subsequent to the intermediate state according to FIG. 7*b* makes the horizontal section 52*a* approach the metallic section 11*b* very closely and the circumferential step 60 reaches now the horizontal section 30*h* of the plastics layer 30. As regards the nature of the plastics layer, reference is made to the introduction, cf. page 3, third paragraph.

The lower end of the skirt 12 of the respective closure cap according to FIGS. 1 and 2 is shown neither in FIG. 7*a* nor in FIG. 7*b*. This lower end may be followed by an inward curl or an outward curl according to the two above-mentioned figures.

The aim achieved by this reduction of the length of the neck 52 or the purpose associated therewith is to be seen in a reduction of the amount of material used. It can be achieved that the thread segments approach the 3D sealing area 51 (the sealing profile) more closely, with the sealing effect remaining the same, so that glass (more general: material of the container) can be saved. If hard plastic is used instead of glass, the material saved is hard plastic. Parallel or simultaneously, material is also saved on the cap side. The skirt 12 of the cap can be reduced in length, since it need not extend axially downwards on the glass as far as before for arriving at the thread segments 53 to 58. The fact that there is no change in the sealing area 51 contributes to making it unnecessary that material components, which are no longer required in the axial direction, have to be added in the radial direction, so as to supplement the sealing effect in the radial direction. Instead, the radial dimension of the sealing area in the examples did not change in comparison with the prior art.

The proportions and dimensional data described characterize a short container neck in the mouth area, and while maintaining an equally effective sealing area in the horizontal section of the plastics layer (of the compound or sealing material arranged in the cap), these short dimensions are accomplished by axially shifting the thread segments towards the three-dimensional sealing area 51. In so doing, material above the thread segments 53 to 58 and below the sealing area 51 is removed, saved, and the short dimensions of the neck are achieved in this way. Surprisingly enough, the neck, which has been shortened to a certain extent, allows the person skilled in the art to save not only material for the container but also sheet metal material for the associated cap.

Auxiliary measures or compensation measures for adding at some other point the material saved are not necessary, but the saving is absolute.

The above is advantageously supplemented by a third effect occurring as a surprise. It is the opening force or break-open moment, which a user or a person handling the closure cap has to apply for unscrewing the closure cap from the thread segments and for opening the closed container for accessing the product F filled therein. Here, a specially small force is accomplished by the shorter neck section, since the removed zone at the end of the vertical section of the three-dimensional sealing area above the axial upper ends of the thread segments created part of the friction, and since this is now no longer the case.

In spite of the advantageous elimination of part of the static friction, the sealing effect and the retaining effect at the thread segments are as good as those achieved in the prior art, these effects being, however, accomplished by using a smaller amount of material.

The invention claimed is:

1. A container made of glass or hard plastic having a container neck (52) with a plurality of external thread elements (53, 54, 55, 56, 57, 58), as thread segments, circumferentially offset relative to one another, a sheet metal closure cap that closes the container when the closure cap is positioned on the container, wherein the closure cap (1, 2) has on an inside of the cap and on a rim of the cap a circumferential plastics layer (30; 30*h*, 30*v*) providing a sealing and retaining function, and the closure cap is adapted to be pressed onto the container neck (52) and over the thread elements (53, 54, 55, . . . ) during closing and a vertical section (30*v*) of the plastics layer is openable by a rotary movement relative to the thread segments (53, 54, 55, . . . ); and wherein the container neck (52) has an upper horizontal end face (52*a*) as an annular surface adapted and suitable for pressing into a horizontal section (30*h*) of the plastics layer (30; 30*h*, 30*v*) of the closure cap (1, 2) under pressure and for producing a seal under pressure; wherein a ratio of an axial spacing ($h_{54}$) to an annular width ($b_{52}$) is less than 1.35, and (a) the axial spacing ($h_{54}$) is defined to extend between axially upper ends of the thread segments and a horizontal plane ($E_{52a}$) through the horizontally oriented end face (52*a*) of the container neck (52) of the container (50); and (b) the annular width ($b_{52}$) of the upper horizontal end face (52*a*) is defined as an annular surface.

2. The container according to claim 1, wherein the ratio of the axial spacing ($h_{54}$) to the annular width ($b_{52}$) is less than 1.0.

3. The container according to claim 1, wherein the container neck (52) has an outwardly directed step (60) positioned axially above upper ends of the thread segments (53, 54, 55, 56, 57, 58) and below the horizontal end face (52*a*), the container neck (52) being capable of producing, up to this step (60), a seal under pressure by pressing into a horizontal section (30*h*) of the plastics layer (30; 30*h*, 30*v*).

4. The container according to claim 1, wherein the ratio of the axial spacing ($h_{54}$) to the annular width ($b_{52}$) is less than 0.9.

5. A method of closing a glass container, the method comprising:

providing the glass container as a container made of glass, having a container neck with a plurality of external thread elements, circumferentially offset relative to one another, the glass container being closable by receiving a metallic closure cap made of sheet metal at the container neck;

wherein the metallic closure cap has on an inside thereof and on a rim portion thereof a circumferential plastics layer providing sealing and retaining of the metallic closure cap, wherein the metallic closure cap is adapted to be pressed onto the container neck and over the thread elements during closing and an axial section of the plastics layer provides for a rotary movement of the metallic closure cap relative to the thread segments for opening the glass container;

wherein the container neck has an upper horizontal end face as an annular surface adapted and suitable for pressing into a horizontal section of the plastics layer of the closure cap under pressure, thereby providing a seal under pressure;

and wherein:

an axial spacing is defined, extending between axially upper ends of the thread segments and a horizontal plane, extending through the horizontally oriented end face of the container neck of the glass container;

an annular width of the upper horizontal end face is defined as an annular surface; and a ratio of the axial spacing to the annular width that is less than 1.35;

pressing the metallic closure cap onto the container neck of the glass container, thereby an axial section of the plastics layer provided on an inside of the metallic closure cap at a skirt section thereof, enters into an axially locking contact with the thread segments at the container neck.

* * * * *